United States Patent [19]

Inouye et al.

[11] Patent Number: 4,723,488

[45] Date of Patent: Feb. 9, 1988

[54] APPARATUS FOR INTERMITTENTLY FEEDING CONTINUOUS PAPER IN A PRINTING PRESS

[75] Inventors: Yoshinori Inouye, Ohtsu; Kouzou Tameno, Shiga; Kosuke Yotsuzuka, Ohtsu; Hiroshi Yamada, Kusatsu; Yuzo Imabori, Hikone, all of Japan

[73] Assignee: Toray Industries, Inc., Tokyo, Japan

[21] Appl. No.: 900,791

[22] Filed: Aug. 27, 1986

[30] Foreign Application Priority Data

Sep. 4, 1985 [JP] Japan ..... 60-196925

[51] Int. Cl.[4] ..... B41F 9/00; B41F 5/04; G03G 15/00

[52] U.S. Cl. ..... 101/143; 101/218; 101/232; 493/10; 493/24; 493/411; 493/414; 226/8; 226/45; 226/143

[58] Field of Search ..... 101/143, 178, 182, 218, 101/223, 232–233, 247; 270/4, 18, 39; 493/10, 13–20, 23–24, 400, 410–411, 414, 417; 226/8, 27, 29, 32, 45, 143

[56] References Cited

U.S. PATENT DOCUMENTS

| | | | |
|---|---|---|---|
| 3,334,897 | 8/1967 | Sharkey | 101/232 |
| 3,426,680 | 2/1969 | Kaufmann | 101/228 |
| 3,797,389 | 3/1974 | Wolff | 101/228 |
| 3,809,387 | 5/1974 | Heist | 493/10 |
| 3,829,080 | 8/1974 | Braen et al. | 270/39 |
| 3,913,904 | 10/1975 | Occhetti | 270/39 |
| 4,054,283 | 10/1977 | Rayfield | 493/10 |
| 4,070,951 | 1/1978 | Bala | 493/24 |
| 4,328,749 | 5/1982 | Inouye et al. | 101/143 |
| 4,473,009 | 9/1984 | Morgan | 101/232 |
| 4,643,090 | 2/1987 | McKrell et al. | 101/247 |

*Primary Examiner*—E. H. Eickholt

*Attorney, Agent, or Firm*—Lowe, Price, LeBlanc, Becker & Shur

[57] ABSTRACT

An impression cylinder (11) and a blanket cylinder (2) are made in contact with/separated from each other at prescribed timing. Continuous paper (12) inserted between the impression cylinder (11) and the blanket cylinder (2) is intermittently fed in association with the said timing for printing. A pin feed tractor (13) arranged on an inlet side of a printing position forward/reversely feeds and stops the continuous paper (12) at timing previously set in relation to the said timing for contact-/separation. A suction conveyer (14) arranged on an outlet side of the printing position sucks and conveys the printed continuous paper (12) while switching its suction force in plural of stages in relation to the said paper feeding timing.

22 Claims, 69 Drawing Figures

REFERENCE Z SIGNAL

PIN FEED TRACTOR DC SERVO MOTOR

IMPRESSION CYLINDER PULSE MOTOR

MAIN SHUTTER

AUXILIARY SHUTTER

CONVEYER SUCTION FORCE

TIMING
V
X1
NORMAL ROTATION
X2
Y
INVERSE ROTATION
STOP
CONTACT
SEPARETE
CONTACT
OPEN
CLOSE
OPEN
CLOSE
STRONG
WEAK
MEDIUM
PRINTING INTERVAL
EFFCTIVE CIRCUMFERENTIAL LENGTH OF BLANKET CYLINDER
t1 t2 t3 t4 00 t5 t6 t7 t8 t1 t2 t3 t4 00

A SIGNAL OUTPUTTED FROM REFERENCE ROTARY ENCODER

VOLTAGE OBTAIND BY F-V CONVERSION OF A SIGNAL

VOLTAGE OBTAINED BY F-V CONVERSION OF OUTPUT SIGNAL FROM PULSE SIGNAL PROCESSING UNIT

APPARATUS FOR INTERMITTENTLY FEEDING CONTINUOUS PAPER IN A PRINTING PRESS

BACKGROUND OF THE INVENTION

1. Field of the Invention

The present invention relates to an apparatus for intermittently feeding continuous paper to be employed in a printing press which has an impression cylinder and a transfer cylinder rolling oppositely and makes the impression cylinder in contact with/separated from the transfer cylinder at prescribed timing thereby to perform printing on the continuous paper.

2. Description of the Prior Art

In general, business forms have been printed through use of a high-speed-rotary press for business form printing. However, such a business form printing rotary press is extremely large-sized and requires much time for switching and adjusting printing patterns while causing a considerable amount of spoilage during the adjustment, and hence there have been developed various simpler offset business form printing presses for small-lot printing of business forms. Such a business form printing press is generally adapted to make an impression cylinder in contact with/separated from an blanket cylinder at prescribed timing to intermittently feed continuous paper inserted between the impression cylinder and the blanket cylinder in assosciation with the said timing for business form printing. However, a means for separating the continuous paper sticked to the blanket cylinder during the printing process, for example a delivery roller, is arranged directly in the downstream side of a printing position to be in contact with the printed surface of the continuous paper avoiding printing parts, and hence such a printing press cannot be appropriately employed as the so-called production run printing press for printing business forms entirely over the lateral direction of the continuous paper, although the same is suitable for the so-called imprinting for partially printing the continuous paper. Further, the timing for intermittent paper feeding is controlled by a mechanical means such as a latchet mechanism, and when the continuous paper is varied in vertical size, for example, gears of the latchet must be exchanged to change the number of gear tooth in response to the said variation in vertical size or the blanket cylinder itself must be replaced by that of a different diameter. Thus, it has been impossible to satisfy requirement for simply and readily printing buisness forms on continuous paper with variation in vertical size.

SUMMARY OF THE INVENTION

The present invention is directed to an apparatus for intermittently feeding continuous paper to be employed in a printing press for making an impression cylinder in contact with/separated from an transfer cylinder at prescribed timing while intermittently feeding continuous paper inserted between the impression cylinder and the transfer cylinder in association with the said timing thereby to perform printing on the continuous paper. An apparatus for intermittently feeding continuous paper according to the present invention comprises paper feeding means arranged on an inlet side of a printing position for forward and reverse feeding and stopping the continuous paper at timing previously set in association with timing for making an impression cylinder in contact with/separated from a transfer cylinder and a suction conveyer arranged on an outlet side of the printing position for sucking and conveying the printed continuous paper to a discharge side while switching its suction force in a plurality of stages in relation to the paper feeding timing, thereby to separate the printed continuous paper from the transfer cylinder through the operation of the suction conveyer.

Accordingly, a principal object of the present invention is to overcome the aforementioned disadvantages of the prior art and provide an apparatus for intermittently feeding continuous paper which enables to print all over the lateral direction of the continuous paper with simple structure in order to, for example, employ the aforementioned offset business form printing press as a Fortdruck printing press.

Another object of the present invention is to provide an apparatus for intermittently feeding continuous paper which realizes correct intermittent paper feeding with stabilized tension while enabling high-density printing over the entire surface of the continuous paper.

Still another object of the present invention is to overcome the aforementioned disadvantages of the prior art and provide an apparatus for controlling intermittent feeding of continuous paper for implementing a printing press which can simply and readily perform arbitrary printing on the continuous paper with variation in vertical size without exchanging mechanical parts.

In a preferred embodiment of the present invention, a means for generating a reference signal related to the rotational phase of the transfer cylinder is provided to apply electronic control for reflecting variation in rotation of the transfer cylinder to paper feeding by a paper feeding means in fidelity, thereby to realize printing in high accuracy.

In the apparatus according to the present invention, a suction conveyer is arranged on a downstream (outlet) side of a position for making an impression cylinder in contact with/separated from a transfer cylinder to convey the printed continuous paper to a discharge side by suction force while switching the suction force in a plurality of stages in relation to timing for feeding the continuous paper, whereby the printed continuous paper sticked to the transfer cylinder during the printing process can be easily separated from the transfer cylinder without providing separation means such as a delivery roller while the continuous paper can be easily reverse fed by switching the suction force without damaging the continuous paper. Thus, arbitrary line drawings such as business forms can be easily printed entirely over the lateral direction of the continuous paper with simple structure.

These and other objects, features, aspects and advantages of the present invention will become more apparent from the following detailed description of the present invention when taken in conjunction with the accompanying drawings.

DESCRIPTION OF THE PREFERRED EMBODIMENTS

Entire Structure

Figure 1:
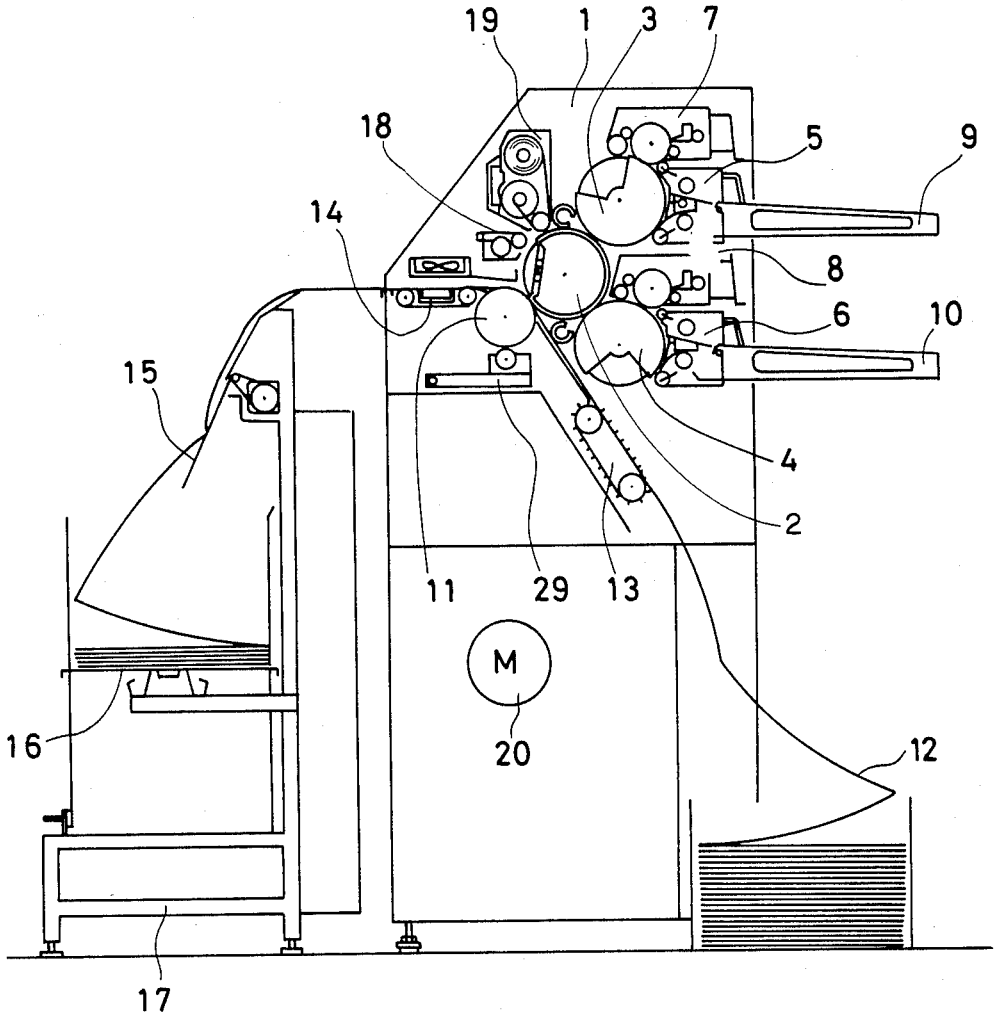
FIG. 1 is a schematic sectional view showing a multicolor offset printing press.

FIG. 1 is a schematic sectional view showing a multicolor offset printing press to which an apparatus for intermittently feeding continuous paper according to the present invention is applied for enabling printing on the continuous paper. As shown in FIG. 1, a blanket cylinder 2 is arranged substantially in a central position of a printing press body 1, and plate cylinders 3 and 4 are contactably arranged at the back of upper and lower portions of the blanket cylinder 2. Detachably mounted on backward positions of the plate cylinders 3 and 4 are plate feeding/discharging units 5 and 6 for enabling automatic plate feeding to/discharging from corresponding ones on the plate cylinders 3 and 4 and inking units 7 and 8 for inking plates wound around corresponding ones of the plate cylinders 3 and 4, while plate feeding/discharging trays 9 and 10 are detachably mounted on the plate feeding/discharging units 5 and 6 respectively.

On the other hand, an impression cylinder 11 is arranged in front of the lower portion of the blanket cylinder 2 to be in contact with/separated from the blanket cylinder 2, and a pin feed tractor 13 and a suction conveyer 14 are arranged in front and at the back of the lower portion of the impression cylinder 11 respectively to control feeding of continuous paper 12 inserted between the impression cylinder 11 and the blanket cylinder 2. The pin feed tractor 13 and the suction conveyer 14 are adapted to control intermittent feeding of the continuous paper 12 in relation to the timing of contact/separation of the impression cylinder 11 and the blanket cylinder 2, for performing printing on the continuous paper 12. Provided in front of the printing press body 1 is a folder 17 having a swing guide 15 and a delivery table 16 for alternately folding the printed continuous paper 12 and receiving the same.

Detachably mounted on an upper front position of the blanket cylinder 2 are a detergent solution feeding unit 18 for feeding a detergent solution to the blanket cylinder 2 and a wiping unit 19 for wiping out the detergent solution respectively. Further, an impression cylinder cleaning unit 29 is arranged under the impression cylinder 11 for cleaning the surface thereof.

A main motor 20 is provided in a lower space of the printing press body 1 to drive the blanket cylinder 2 and the suction conveyer 14 through, e.g., belts while the blanket cylinder 2, the plate cylinders 3 and 4 and the impression cylinder 11 are mechanically interlocked by gears arranged to be engaged at single end portions of the said cylinders, to form a driving system through the main motor 20. Driving units or actuators such as pulse motors and solenoids are mounted on the remaining mechanical portion at need, and sensors and switches are appropriately mounted on prescribed portions as data input means for controlling driving timing for the driving system.

Figure 2:
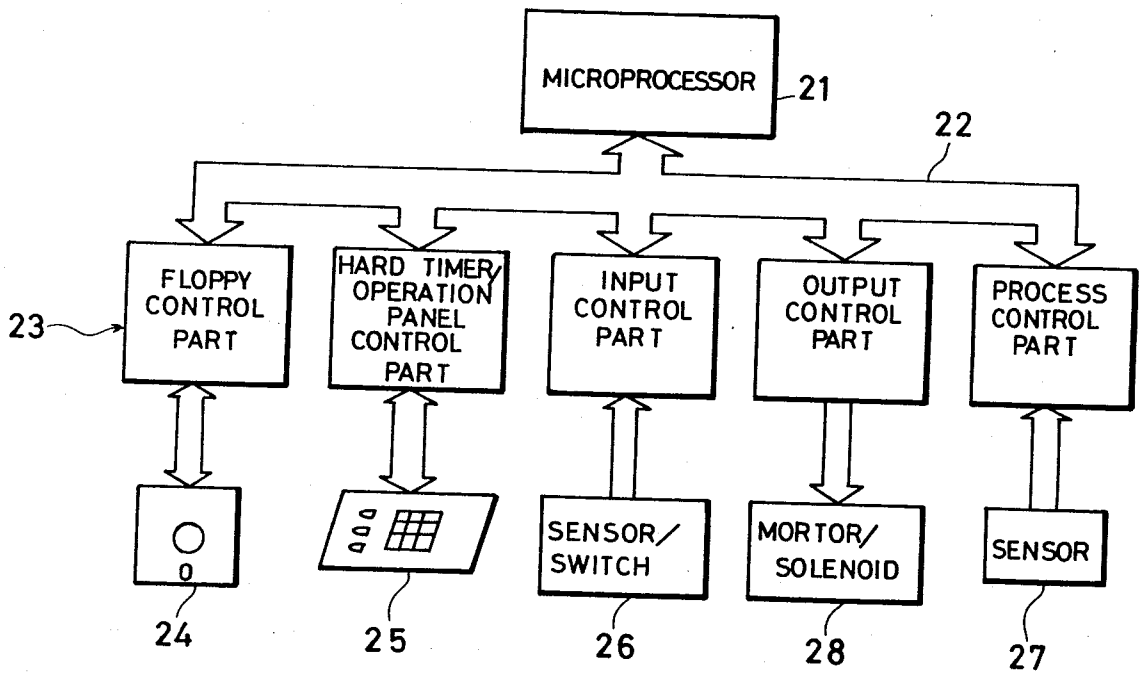
FIG. 2 is a schematic block diagram showing a control system.

FIG. 2 schematically shows a control system employed in the printing press, in which a microprocessor 21 is connected with external units 24 to 28 through a control bus 22 and respective control parts 23. A system program is stored in an external memory unit 24 such as a floppy disk, to be supplied to the microprocessor 21 for starting the system. An operator supplies a command through an operation panel 25 provided on the side portion of the printing press body 1 for example, so that the microprocessor 21 fetches required data from sensor/switch means 26 and 27 to appropriately drive a driving system 28 formed by motors, solenoids and the like in accordance with the system program.

Paper Conveyeing System

A paper conveying system of this printing press is formed by the pin feed tractor 13 and the suction conveyer 14, to control feeding of the continuous paper 12 in relation to rotation of the blanket cylinder 2 and the condition of the impression cylinder 11 (contact/separation to the blancket cylinder 2) on the basis of commands from the microprocessor 21. The continuous paper 12 may be provided by folded paper having folds or machine folds in the vertical direction or rolled paper having no such folds, which is provided in horizontal ends with marginal punchholes to be engaged with pins of the pin feed tractor 13. The following description is made on the case of employing the folded paper.

Structure of Pin Feed Tractor

Figure 3A:
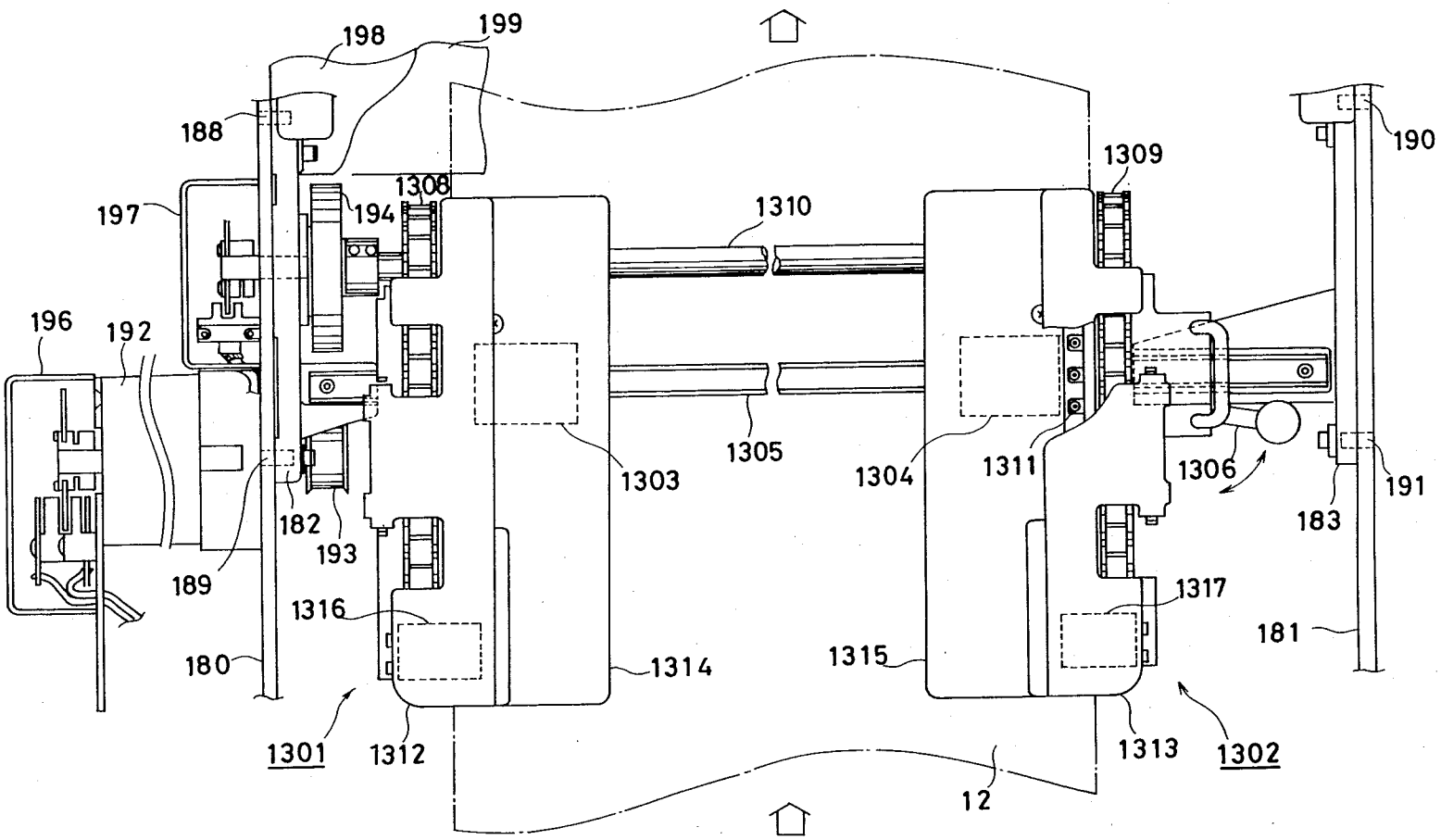
FIGS. 3A to 3E(*b*) are mechanical explanatory diagrams of a pin feed tractor.
Figure 3B:
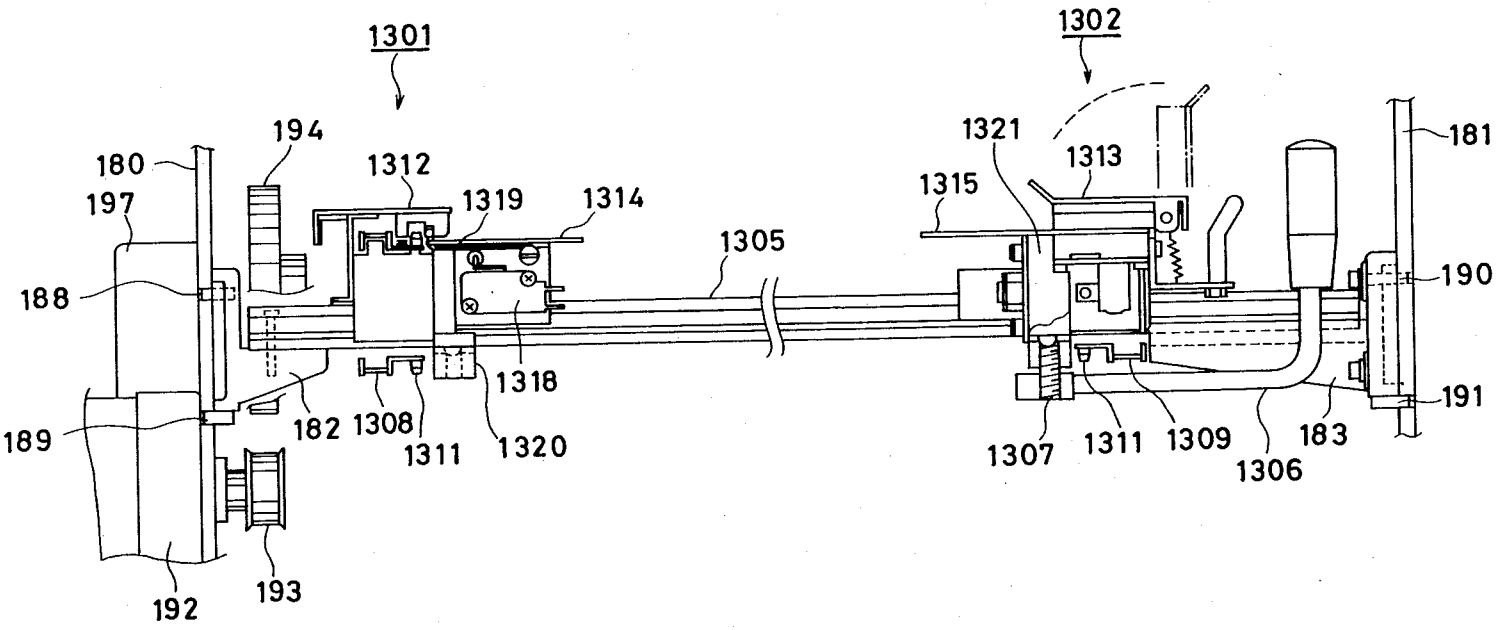
Figure 3C:
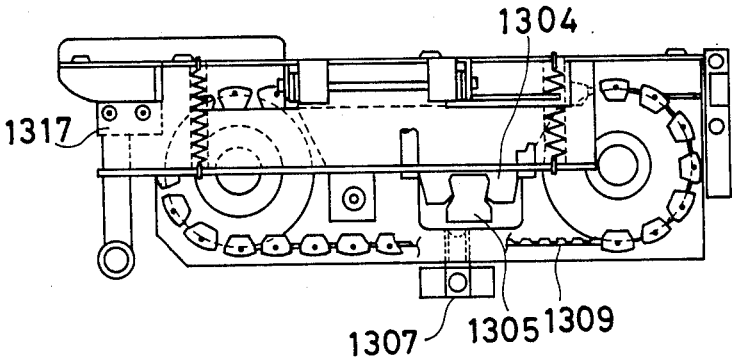

FIGS. 3A, 3B and 3C are an explanatory plan view, an explanatory front sectional view and an explanatory right side elevational view showing the mechanism of the pin feed tractor 13 according to an embodiment of the present invention. The pin feed tractor 12 is formed by making assembly reference planes of a left tractor frame 1320 and a right tractor frame 1321 in contact with reference planes of moving elements 1303 and 1304 of a high-accuracy linear bearing respectively in parallel registration and fixing the same, and mounting respective parts of left and right tractor units 1301 and 1302 on the left and right tractor frames 1320 and 1321 to unify the same. Namely, the left and right tractor units 1301 and 1302 can be registered in parallel with each other without utilizing jigs etc. The left moving element 1303 is fixed to a stationary position of a guide rail 1305 of the linear bearing while the right moving element 1304 is unfixed to be horizontally slidable along the guide rail 1305, to arbitrarily vary the interval between the left and right tractor units 1301 and 1302 with the paper width of the continuous paper 12.

Upwardly engaged with the lower part of the moving element 1304 of the right tractor unit 1302 is a screw 1307 having a flat-surface ball, which is adapted to rotate in response to rotation of a lever 1306. The lever 1306 is rotated in the anticlockwise direction to upwardly urge the screw 1307 and press the flat surface ball in its forward end against the guide rail 1305 of the linear bearing, thereby to lock the right tractor unit 1302 at a desired position by the pressing force. The left tractor 1301 is also fixed in the stationary position by a similar screw having a flat surface ball.

Figure 3D:
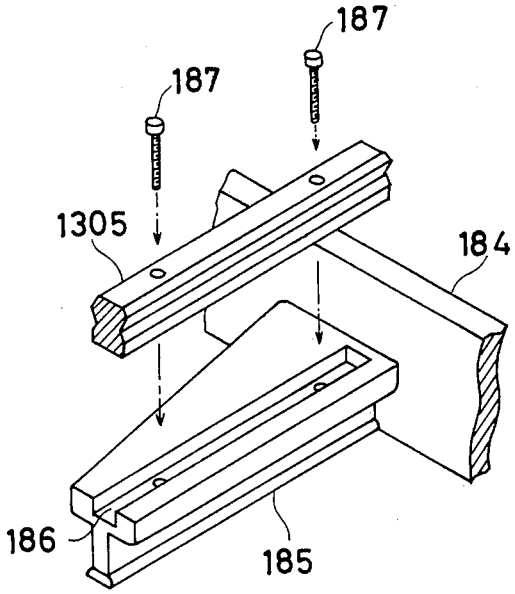
Figure 3E:
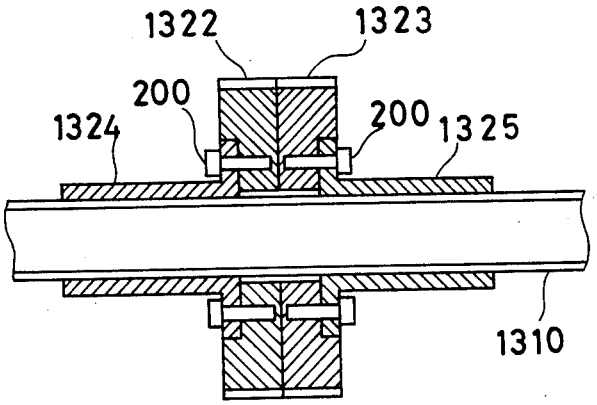
Figure 3E:
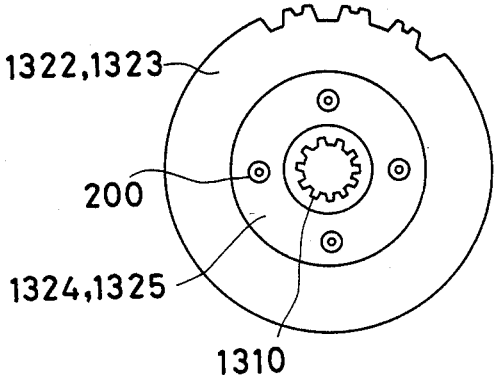

The left and right tractor units 1301 and 1302 are respectively provided with paper conveyer timing belts 1308 and 1309 which are extended along front and rear pairs of pulleys, so that horizontal front pulleys are connected with each other by a spline shaft 1310 to rotatingly drive the same thereby to synchronoously forward/reverse drive left and right paper conveyer timing belts 1308 and 1309. The left and right paper conveyer timing belts 1308 and 1309 are provided with paper feeding pins 1311 at regular interrvals, to be engaged with the horizontal marginal punchholes of the continuous paper 12 for synchronous forward/reverse drive of the paper conveyer timing belts 1308 and 1309, thereby to forward/reverse feed the continuous paper 12. In order to smoothly feed the continuous paper 12, the paper feeding pins 1311 of the left and right tractor units 1301 and 1302 must be correctly matched in phase, and such phasing of the paper feeding pins 1311 are performed as follows. As shown at FIG. 3E(*a*), left and right front pulleys 1322 and 1323 are previously engaged with left and right bearings 1324 and 1325 respectively in the exterior of the unit, and then the side surfaces of the front pulleys 1322 and 1323 are brought into contact with each other after the engagement to receive the spline shaft 1310. Phasing is performed with reference to the spline shaft 1310 and then the left and right front pulleys 1322 and 1323 are fixed to the left and right bearings 1324 and 1325 respectively by screws 200 to establish correct phase relation, and finally the pair of front pulleys 1322 and 1323 are assembled in the left and right tractor units 1301 and 1302 respectively. As shown at FIG. 3E(*b*), the fixing screws 200 are externally mounted on the front pulleys 1322 and 1323 in such a system, whereby phasing can be performed in the exterior of the printing press to facilitate easier operation in comparision with the case of phasing on the printing press and improvement in accuracy.

Paper pressing lids 1312 and 1313 are arranged on the left and right tractor units 1301 and 1302 to cover the upper surfaces of the paper feeding pins 1311 while paper receiving guide plates 1314 and 1315 are respectively arranged in the lower surface sides thereof, to hold the horizontal ends of the continuous paper 12 therebetween and guide the same so that the marginal punchholes are not disengaged from the paper feeding pins 1311.

In order to remove dust sticked to the marginal punchholes of the continuous paper 12, dust removing portions 1316 and 1317 are arranged respectively in the terminating end portions (inlet side for the continuous paper 12) of the left and right tractor units 1301 and 1302. The dust removing portions 1316 and 1317 are oppositely provided with dust removing brushes (not shown) and appropriate spaces (not shown) in the upper and lower sides of a passage plane for the continuous paper 12, which spaces are made to be connected with a suction blower (not shown) mounted on the side of the printing press body 1 by, e.g., a flexible tubular material to discharge the air from the spaces through suction by the sunction blower, thereby to suckingly discharge the dust.

A paper detecting limit switch 1318 is mounted on a central portion in the lower side of the paper receiving guide plate 1314 of the left tractor unit 1301 in the fixed side while a working spring 1319 for driving the paper detecting limit switch 1318 is upwardly projected from the left-hand end of the paper receiving guide plate 1314 so that the working spring 1319 is downwardly pressed upon setting of the continuous paper 12 to drive the paper detecting limit switch 1318, which in turn detects presence of the continuous paper 12.

The unit of the pin feed tractor 13 formed in the aforementioned manner is mounted between left and right main frames 180 and 181 of the printing press body 1 through left and right brackets 182 and 183. As shown in FIG. 3D, each of the left and right brackets 182 and 183 is formed by a frame mounting portion 184 and a rail receiving portion 185, and a groove 186 is formed in the rail receiving portion 185 to engagingly receive the guide rail 1305 of the linear bearing and fix the same by screws 187.

The left and right brackets 182 and 183 are mounted on prescribed positions of the left and right main frames 180 and 181, to be registered with reference to pairs of registration knock pins 188, 189 and 190, 191 previously formed in prescribed positions of the left and right main frames 180 and 181. The knock pins 188 and 190 are engaged with registration holes provided in the frame mounting portions 184 to restrict positions for mounting the left and right brackets 182 and 183 on the left and right main frames 180 and 181 while the knock pins 189 and 191 are adapted to restrict angles of inclination of the left and right brackets 182 and 183 in the restricted mounting positions, i.e., the angles of inclination of the pin feed tractor 13 to be mounted thereon.

The guide rail 1305 of the linear bearing is thus engagedly mounted on the rail receiving portions 185 of the left and right brackets 182 and 183 accurately registered and fixed to the prescribed positions of the left and right main frames 180 and 181 of the printing press body 1, whereby the pin feed tractor 13 can be easily mounted on a prescribed position of the printing press body 1 at a prescribed angle. When mounted on the printing press body 1, a paper set reference position $P_1$ (refer to FIG. 9) of the pin feed tractor 13 is positioned by a prescribed distance H from a printing starting position $P_2$.

As hereinabove described, the left and right tractor units 1301 and 1302 are already registered in parallel with each other and the paper feeding pins 1311 are already phased when the left and right tractor units 1301 and 1302 are respectively fixed to the moving elements 1303 and 1304 of the linear bearing while the moving elements 1303 and 1304 are only horizontally moved parallely on the guide rail 1305, and hence the said parallel relation and phasing relation after adjustment will not be damaged till the guide rail 1305 is mounted on the left and right brackets 182 and 183. Thus, no complicated re-adjustment such as parallel registration of the left and right tractor units 1301 and 1302 and phasing of the paper feeding pins 1311 is required when the unified and completely assembled pin feed tractor 13 is mounted on the printing press body 1. Further, such adjustment can easily and correctly be performed in the exterior of the printing press before the pin feed tractor 13 is mounted on the printing press body 1.

A tractor driving DC servo motor 192 is arranged in the exterior of the left main frame 80 of the printing press body 1 and a pulley 193 connected with the driving shaft of the Dc servo motor 192 is provided in the interior of the left main frame 180, while a timing belt (not shown) is extended between the pulley 193 and a timing pulley 194 similarly provided in the interior of the left main frame 180. The driving system is so formed that the timing pulley 194 is registered with and fixed to the spline shaft 1310 to rotate the spline shaft 1310 in response to rotation of the DC servo motor 192 thereby to forward/reverse drive the left and right paper conveyer timing belts 1308 and 1309. A rotary encoder 196 is mounted on the driving shaft of the DC servo motor 192 to detect the number of rotation of the DC servo motor 192, i.e., paper conveying rate and another rotary encoder 197 is mounted on the rotation shaft of the pulley 194 in the exterior of the main frame 180 to detect the rotation of the spline shaft 1310, i.e., the positions of the paper feeding pins 1311.

In front of the pin feed tractor 13, upper and lower guide plates 198 and 199 are extended in immediate front of the impression cylinder 11, so that the continuous paper 12 discharged from the pin feed tractor 13 is inserted between the same and guided to the positione between the blanket cylinder 2 and the impression cylinder 11.

Structure of Suction Conveyer

Figure 4A:
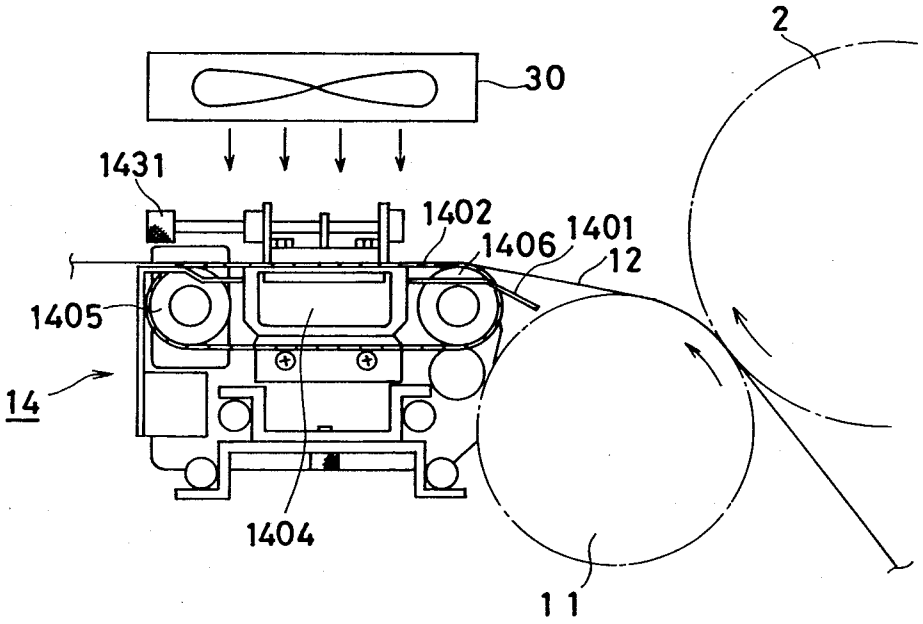
FIGS. 4A to 4G(*f*) are mechanical explanatory diagrams of a suction conveyer.

FIGS. 4A to 4D are mechanical explanatory diagrams showing an embodiment of the suction conveyer 14, which can switch suction force in three stages while its suction width is variable with the paper width. FIG. 4A is an explanatory left side elevational view showing a position for mounting the suction conveyer 14 with relation to the impression cylinder 11. As shown in FIG. 4A, the suction conveyer 14 is registered and fixed between the left and right main frames 180 and 181 of the printing press body 1 (see FIG. 4C) so that a paper guide 1401 is placed in a position slightly ahead of the top of the impression cylinder 11 in the rotational direction and a feeding plane of a conveyer belt 1402 becomes substantially horizontal to horizontally guide the continuous paper 12 obliquely moved between the blanket cylinder 2 and the impression cylinder 11. A blast means formed by a paper pressing fan 30 is provided above the suction conveyer 14 to send a blast to the upper surface of the suction conveyer 14, thereby to prevent upward separation of the continuous paper 12 from the upper surface of the suction conveyer 14 in paper feeding operation.

Figure 4B:
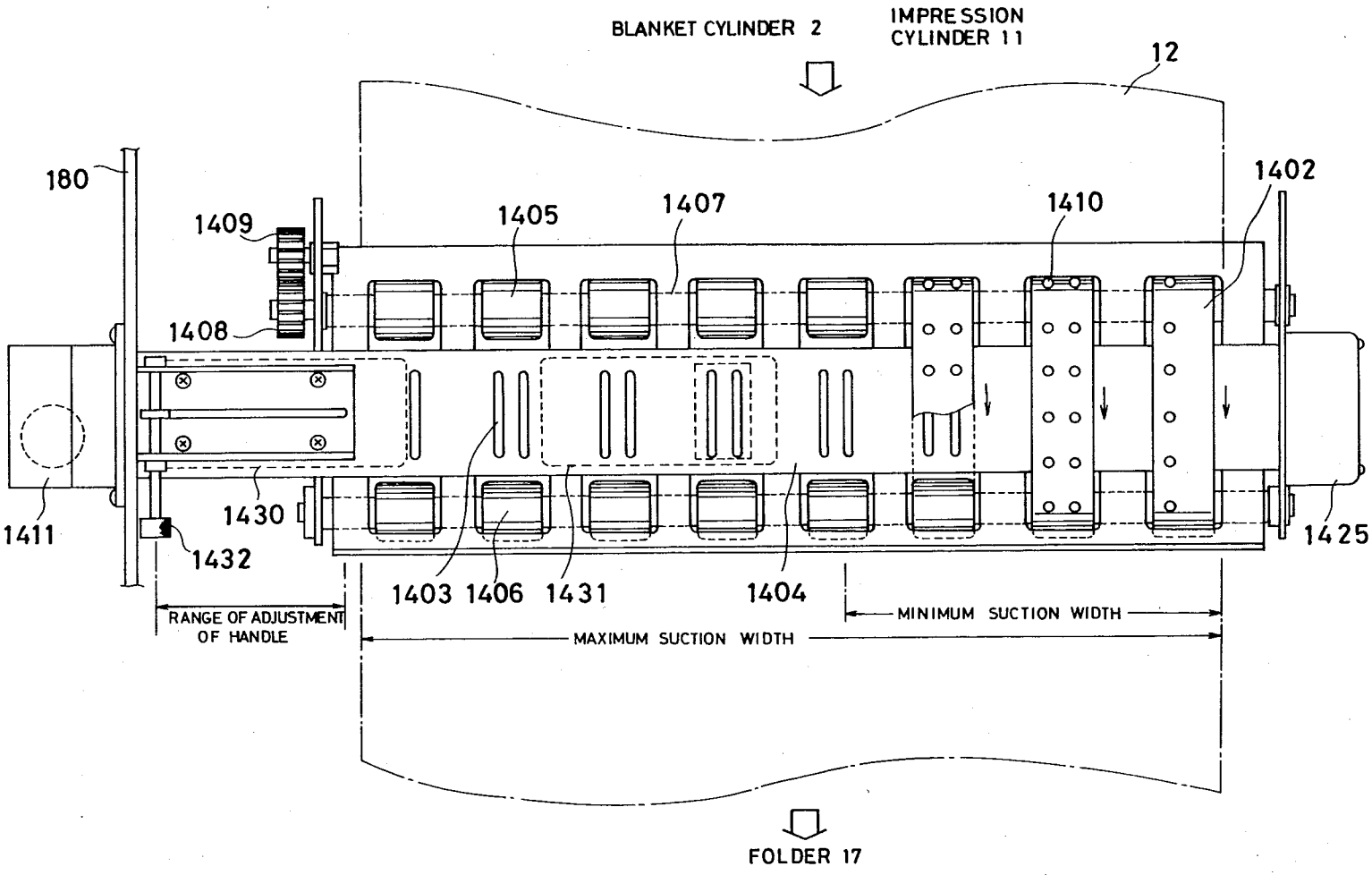
Figure 4C:
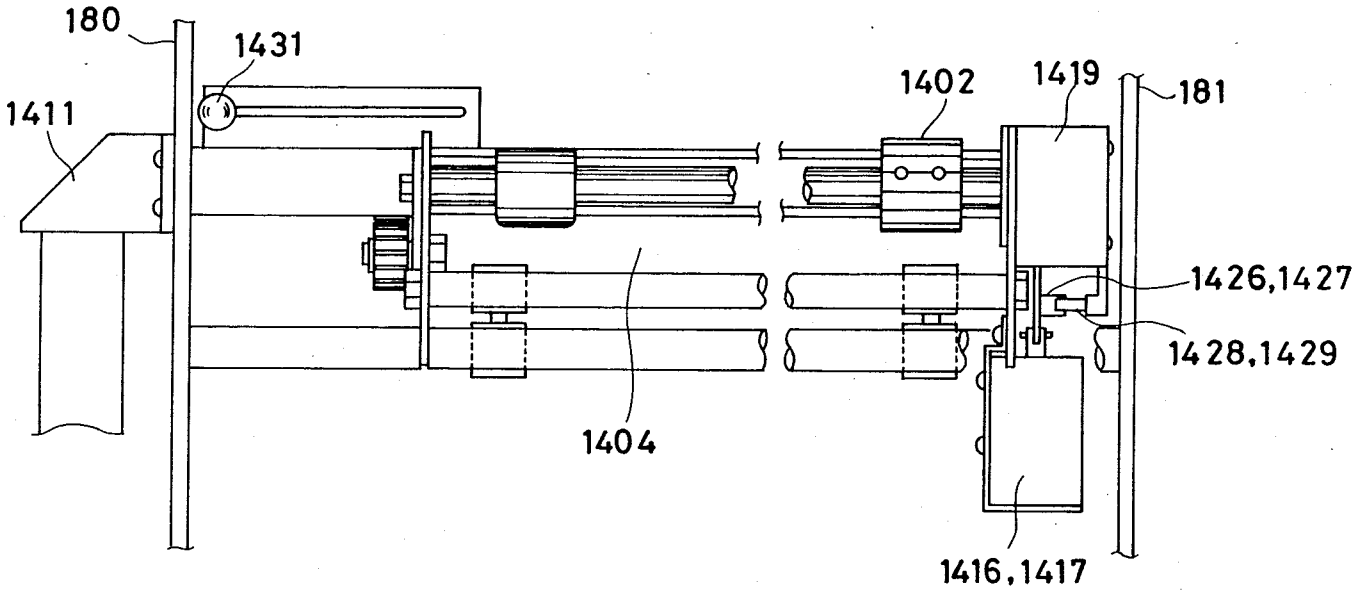
Figure 4D:
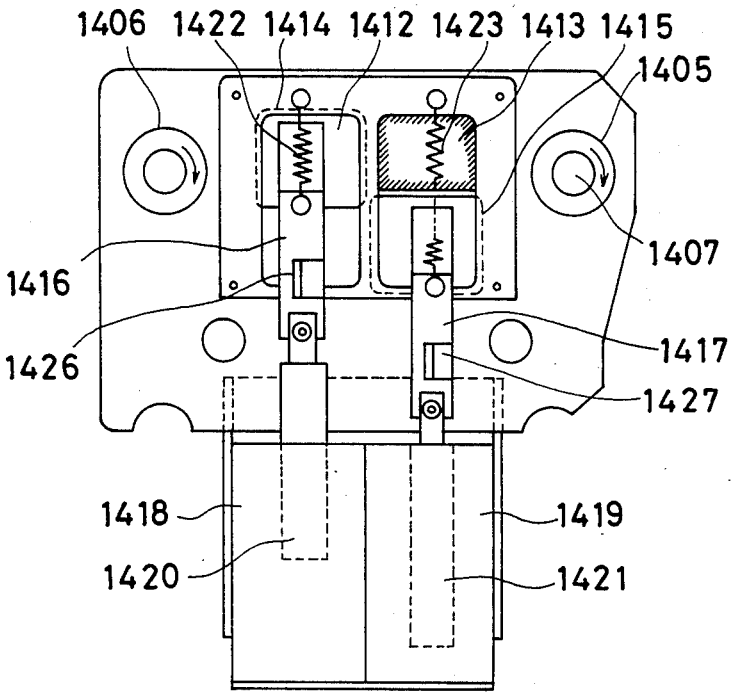

FIGS. 4B, 4C and 4D are mechanical explanatory plan, front elevational and right side elevational views of the suction conveyer 14 respectively. A suction duct 1404 having a number of suction slits 1403 in its upper surface is extended along the horizontal center of the suction conveyer 14, and a pair of pulleys 1405 and 1406 are provided per pair of suction slits 1403 in the front and rear portions of the suction duct 1404. A conveyer belt 1402 is wound around each pair of pulleys 1405 and 1406 while a gear 1408 is engagedly mounted on the left end of a common rotary shaft 1407 of the front pulleys 1405, so that the gear 1408 is engaged with a driving gear 1409 mechanically connected with the main motor 20 through, e.g., a belt to constantly feed the conveyer belt 1402 in response to rotation of the main motor 20. The conveyer belt 1402 is provided with a number of suction holes 1410 in positions corresponding to the suction slits 1403. By virtue of such structure, the continuous paper 12 discharged from the impression position between the blanket cylinder 2 and the impression cylinder 11 is guided in the direction of the folder 17 while being sucked on the upper surface of the feeding conveyer 1402.

The left end of the suction duct 1404 is connected with a suction blower (not shown) through a connecting portion 1411 provided in the exterior of the main frame 180, to suck and discharge the air in the suction duct 1404 in response to rotation of the suction blower. On the other hand, the right end of the suction duct 1404 is provided with two openings 1412 and 1413 as well as a main shutter 1414 in correspondence to one of the openings and an auxiliary shutter 1415 in correspondence to the other opening. The main and auxiliary shutters 1414 and 1415 are connected with armatures 1420 and 1421 of suction force switching solenoids 1418 and 1419 respectively through connection members 1416 and 1417, which are supplied with upward return force by return springs 1422 and 1423 respectively. The primary and secondary shutters 1414 and 1415 are adapted to close the openings 1412 and 1413 when the solenoids 1418 and 1419 are not energized, while corresponding main shutter 1414 and/or auxiliary shutter 1415 downwardly slides upon energization to open the opening 1412 and/or 1413.

Figure 4E:
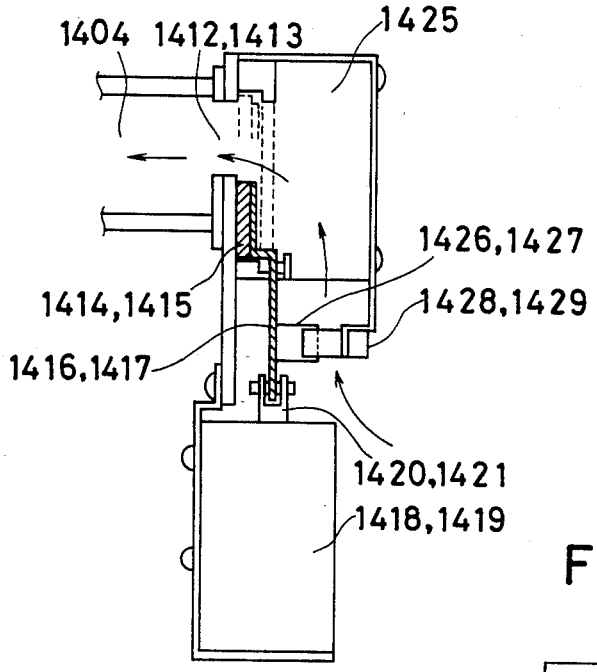
Figure 4E:
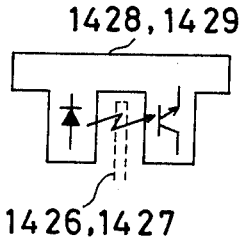

FIG. 4E is an explanatory sectional view showing the above shutter portion. The primary and secondary shutters 1414 and 1415 are provided in a shutter chamber 1425 so that external air sucked through the lower portion of the shutter chamber 1425 is introduced into the suction duct 1404 through the openings 1412 and 1413 when the primary and secondary shutters 1414 and 1415 are in "open" states. Thus, the amount of the external air sucked into the suction duct 1404 through the openings 1412 and 1413 is varied with opening/closing of the primary and secondary shutters 1414 and 1415 to adjust the amount of external air sucked through the suction holes 1410 of the conveyer belt 1402, thereby to switch the suction force in the following three stages:

| primary shutter | secondary shutter | suction force |
|---|---|---|
| closed | closed | strong |
| closed | open | medium |
| open | open | weak |

In order to detect the states of the solenoids 1418 and 1419, i.e., open/closed states of the primary and secondary shutters 1414 and 1415, dousers 1426 and 1427 are respectively provided in the connecting members 1416 and 1417 while photoelectric sensors 1428 and 1429 are respectively provided in positions (those in FIG. 4E(*a*)) to be shielded against light in an energized state, as shown at FIG. 4E(*b*).

Figure 4F:
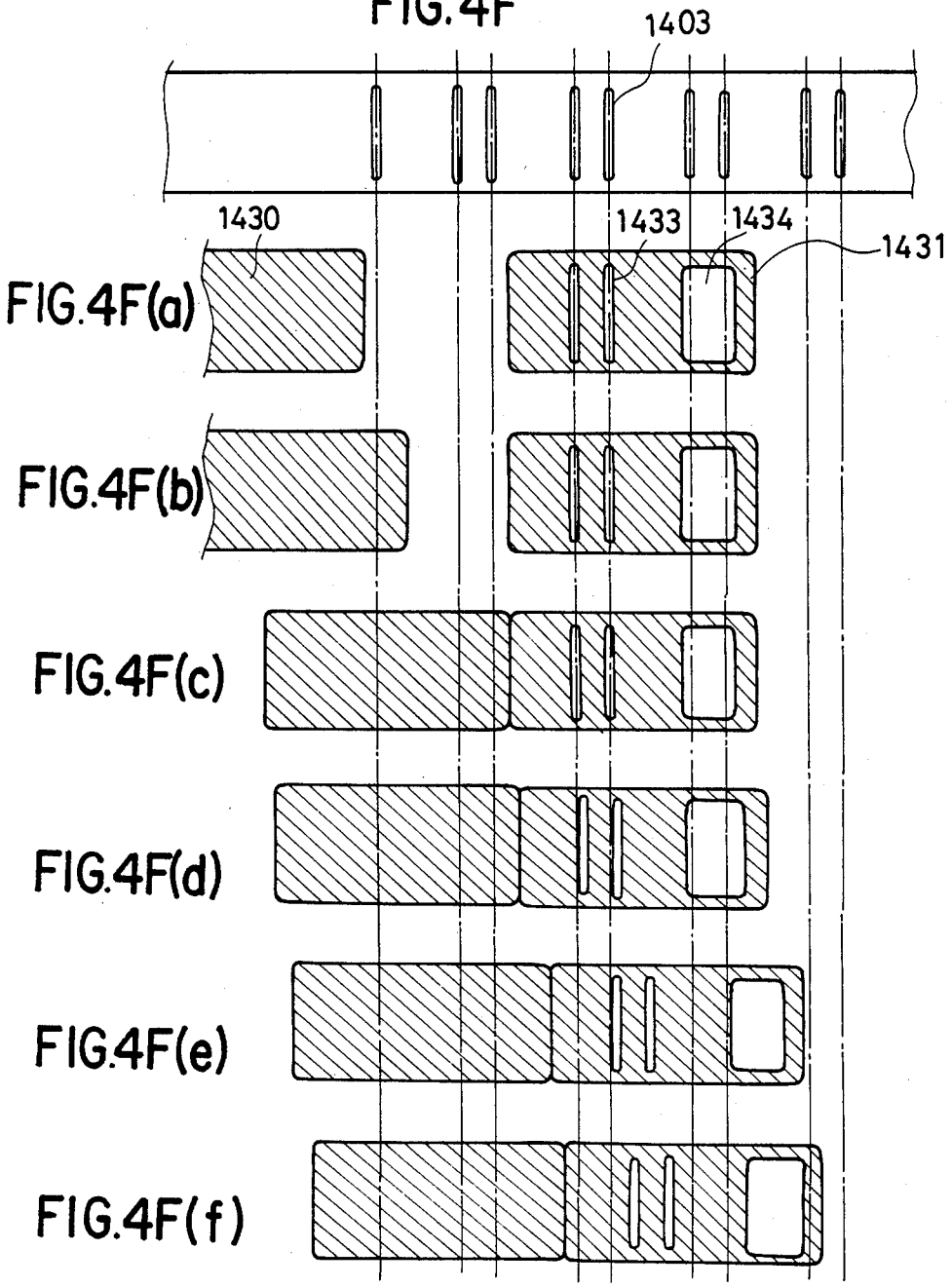
Figure 4G:
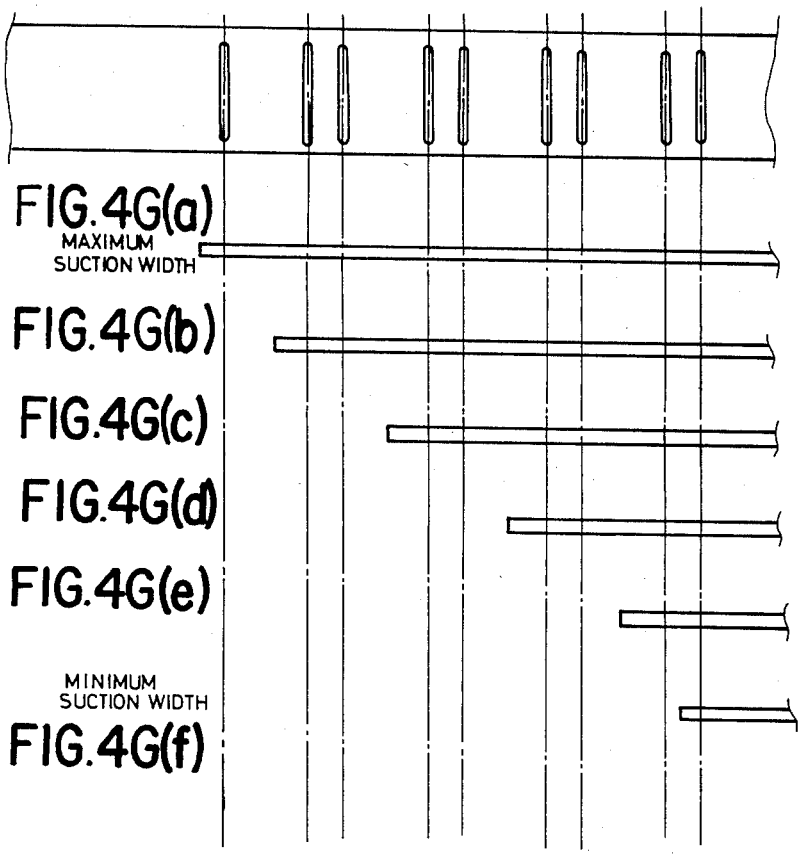

Two stages of sliders 1430 and 1431 are arranged in close contact with the left end of the upper inner side surface of the suction duct 1404 so that the first slider 1430 is slidingly moved in the right direction by a handle 1432 to close the suction slits 1403 within a prescribed range, thereby to adjust the suction width at an arbitrary level between the maximum suction width and the minimum suction width. FIG. 4F shows extrusion of the second slider 1431 following the movement of the first slider 1430 in stages. The second slider 1431 is provided with openings 1433 similarly formed with one pair of suction slits 1430 and a large opening 1434 capable of containing another pair of suction slits 1403 formed in a corresponding position, to gradually shield the suction slits 1403 from the left-hand side by being pressed in the right-hand direction. Lateral bars in FIG. 4G illustrate the manner of variation of the suction width in the respective steps as shown in FIG. 4F. Thus, a large shielding amount can be obtained by a small amount of movement. The second slider 1431 is engaged with a return means such as a spring (not shown) to return to its original position (position shown at FIG. 4F(*a*) and (*b*)) when no pressing force is applied from the first slider 1430.

Contact/Separation Mechanism

Figure 5A:
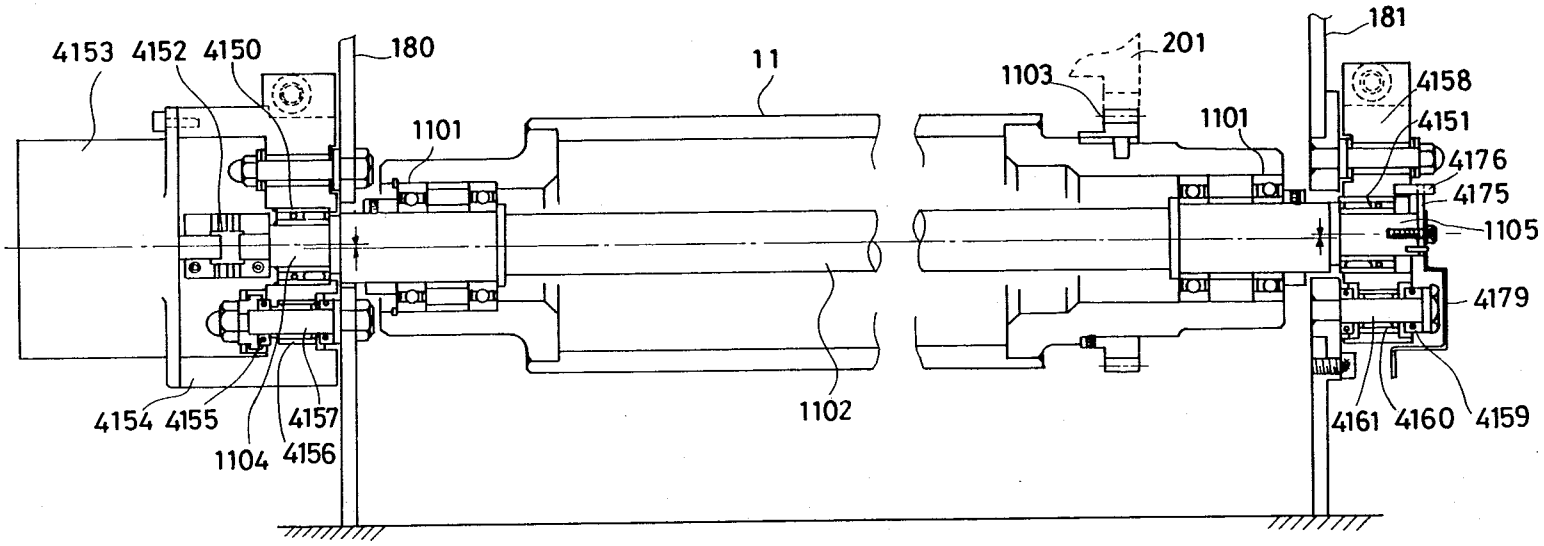
FIGS. 5A to 5D are explanatory diagrams of a mechanism for making an impression cylinder in contact with/separated from a blanket cylinder.

FIG. 5A is an explanatory diagram showing a mechanism for making the impression cylinder 11 in contact with/separated from the blanket cylinder 2. As shown in FIG. 5A, the impression cylinder 11 is arranged to be rotatable about a support shaft 1102 through left and right bearings 1101, and is driven by engagement of a gear 1103 provided on one end portion thereof with a gear 201 provided on one end portion of the blanket cylinder 2 driven by the main motor 20, as hereinabove described. In other words, the impression cylinder 11 is continuously rotatingly driven regardless of the states of contact/separation. Both ends of the support shaft 1102 define eccentric shafts 1104 and 1105, which are supported by eccentric shaft bearing portions 4150 and 4151 provided in the exterior of the left and right main frames 180 and 181. The left eccentric shaft 1104 is connected through a helical coupling 4152 with the rotary shaft of an impression cylinder pulse motor 4153, which in turn rotatingly drives the left eccentric shaft 1104 to move the position of the support shaft 1102 and responsively change the distance between the shafts of the impression cylinder 11 and the blanket cylinder 2, thereby to make the impression cylinder 11 in contact with/separated from the blanket cylinder 2.

Figure 5B:
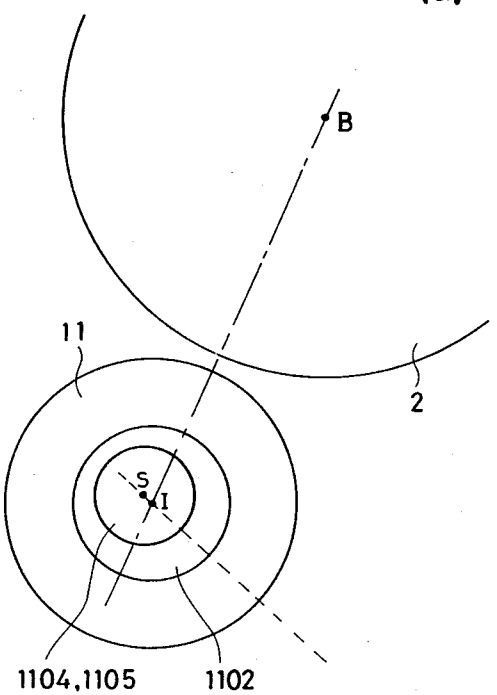
Figure 5B:
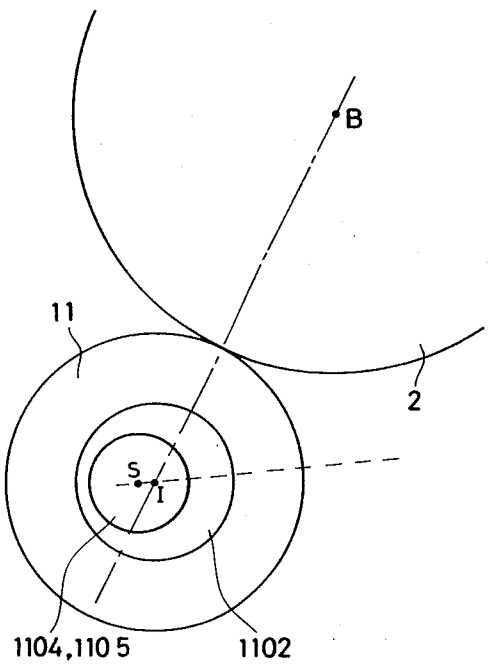
Figure 5B:
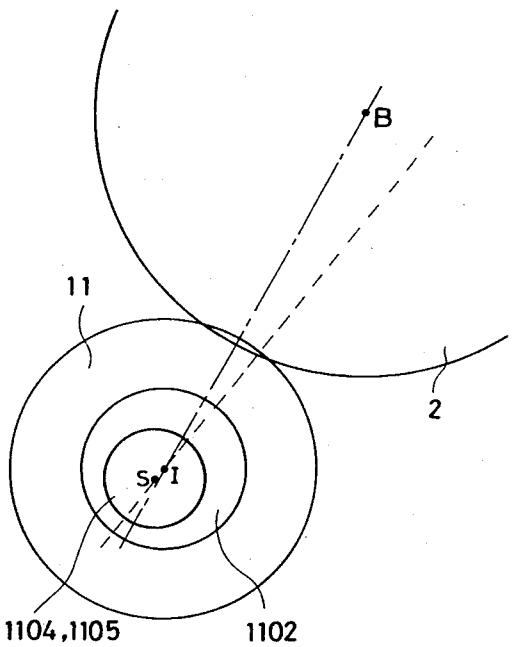

FIG. 5B typically illustrates the states of contact-/separation, where FIG. 5B(*d*) shows the state of separation and FIG. 5B(*b*) and (*c*) show the states of contact. Referring to FIG. 5B, a point B denotes the center of the blanket cylinder 2, a point I denotes the center of the support shaft 1102 (center of rotation of the impression cylinder 11) and a point S denotes the center of the left/right eccentric shaft 1194/1105 (center of oscillation of the impression cylinder 11). In the separated state as shown at FIG. 5(*a*), straight lines SI and BI form a large angle as shown, and this angle is gradually reduced as the left eccentric shaft 1104 is rotated in the anticlockwise direction by the impression cylinder pulse motor 4153, while the impression cylinder 11 is responsively oscillated in the anticlockwise direction about the point S to gradually reduce the distance between the shafts of the impression cylinder 11 and the blanket cylinder 2 (distance between points B and I). When the line SI reaches a position as shown at FIG. 5B(*b*), the impression cylinder 11 comes into contact with the blanket cylinder 2, while the impression cylinder pulse motor 4153 is further driven in order to apply appropriate printing pressure to make the center I of rotation of the impression cylinder 11 further approach the center B of the blanket cylinder 2 till the line SI is in a state as shown at FIG. 5B(*c*) immediately before overlapping the line BI, i.e., further reduce the intershaft distance, to set the position of the impression cylinder 11 as a contact position.

In order to vary the printing pressure with the types of printed materials, the impression cylinder pulse motor 4153 may be driven between the anglese of rotation of the eccentric shafts as shown at FIG. 5(*b*) and (*c*) for example, thereby to appropriately vary the distance between the shafts of the impression cylinder 11 and the blanket cylinder 2. However, when, for example, the impression cylinder 11 is to be retained in a state approximate to the eccentric shaft rotation angle as shown at FIG. 5B(*b*), i.e., when the printing pressure is relatively weak, repulsive force from the blanket cylinder 2 is applied as extremely large moment to the impression cylinder pulse motor 4153 as obvious from the positional relation as shown at FIG. 5B(*b*) and an extremely large-sized pulse motor is required to stably retain such large repulsive force. Thus, such retaining of the impression cylinder 11 is not necessarily practical although it is possible.

In a preferred embodiment of the present invention, therefore, the position shown at FIG. 5B(*c*) is previously set as the contact position as hereinabove described, and the printing pressure is adjusted by a printing pressure adjusting spring mechanism as hereinafter described. The line SI is substantially aligned with the line BI at the position as shown at FIG. 5B(*c*), and hence the repulsive force from the blanket cylinder 2 is applied merely as extremely small moment to the impression cylinder pulse motor 4153. Therefore, a small-sized pulse motor can be employed. The moment applied to the impression cylinder motor 4153 becomes zero when the line Si is aligned with the line BI to reach the top dead center, whereas the rotation of the impression cylinder pulse motor 4153 urged by the repulsive force from the blanket cylinder 2 is instably directed to remarkably damage stability of the mechanism. Thus, it is important to select the position slightly ahead of the top dead center as the contact position as shown at FIG. 5B(*c*), and the lines BI and SI form an angle of about 5 in a preferred embodiment.

Advantages of such employment of the pulse motor as the driving part for the contact/separation mechanism for the impression cylinder 11 are as follows: First, contact/separation sppeds can be easily controlled to reduce impacts applied to the printing press, thereby to increase the life of the printing press. Second, the cylinders can be in contact with/separated from each other at an arbitrary phase, to readily cope with variation in the vertical length of the paper to be printed. Third, the impression cylinder 11 can be retained in a separated position in case of rotating the balanket cylinder 2 while stopping paper feeding for printing continuous paper, whereby no unnecessary tension acts on the continuous paper to damage the marginal punchholes engaged with the pins 1311 of the pin feed tractors 13. Fourth, step-out is caused against retaining force of the impression cylinder pulse motor 4153 when excessive printing pressure is applied, whereby the impression cylinder 11 is naturally separated from the blanket cylinder 2 to serve as a safety device.

Figure 5C:
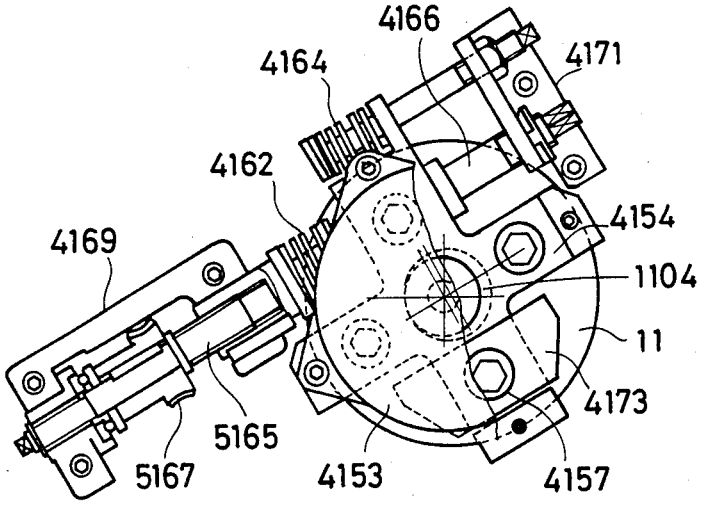
Figure 5D:
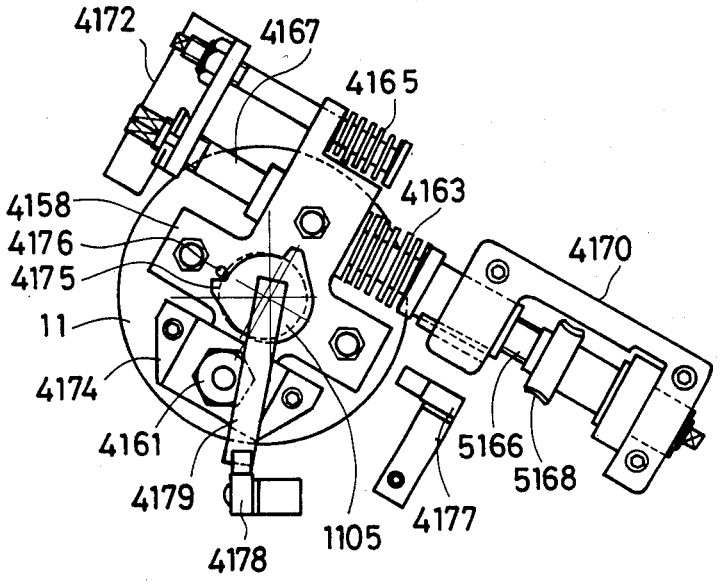

Description is now made on the printing pressure adjusting spring mechanism with reference to FIGS. 5A, 5C and 5D. FIG. 5C is a left side elevational view of the mechanism as shown in FIG. 5A, and FIG. 5D is an explanatory right side elevational view thereof. As shown in FIGS. 5A, 5C and 5D, a cross-shaped printing pressure arm 4154 is mounted in the exterior of the left main frame 180 to be rotatable about the support shaft 4157 through a thrust bearing 155 and a needle bearing 4156 for adjusting the printing pressure, while the support shaft 4157 is reinforced by a pin block 4173 and fixed to the left main frame 180. In correspondence to this, another cross-shaped printing pressure arm 4158 is arranged in the exterior of the right main frame 181 to be rotatable about a support shaft 4161 through a thrust bearing 4159 and a needle bearing 4160, while the support shaft 4161 is reinforced by a pin block 4174 and fixed to the right main frame 181. The left eccentric shaft bearing portion 4150 is inserted in a throughhole defined in the center of the left printing pressure arm 4154 to receive the left eccentric shaft 1104, while the right eccentric shaft bearing portion 4151 is inserted in a throughhole defined in the center of the right printing pressure arm 4158 to receive the right eccentric shaft 1105, so that the support shaft 1102 is oscillated responsively to oscillation of the left and right printing pressure arms 4154 and 4158 and the impression cylinder 11 is responsively oscillated to vary pressing force against the blanket cylinder 2, i.e., the printing pressure. The impression cylinder pulse motor 4153 is placed on and fixed to the left printing pressure arm 4154, to be oscillated with the same. The left and right printing pressure arms 4154 and 4158 are urged in the same oscillation direction (contact direction) by left and right printing pressure primary compression springs 4162 and 4163 and left and right printing pressure secondary compression springs 4164 and 4165, while the range of oscillation is restricted by left and right impression cylinder stoppers 4166 and 4167. When the rotational phase of the impression cylinder pulse motor 4153 is in the separated position (at the phase of FIG. 5B(*a*)), the left and right printing pressure arms 4154 and 4158 are pressed against the impression cylinder stoppers 4166 and 4167 respectively, while the left and right printing pressure arms 4154 and 4158 are separated from the impression cylinder stoppers 4166 and 4167 by the repulsive force form the blanket cylinder 2 when the rotational phase of the impression cylinder pulse motor 4153 is in a contact position (at the phase of FIG. 5B(*c*)) to be stopped in a position with the repulsive force from the blanket cylinder 2 and that of the compression springs 4162 to 4165 being balanced. Thus, the compression springs 162 to 165 are varied in repulsive force to arbitrarily adjust the printing pressure.

In this embodiment, left and right printing pressure adjusting screws 4165 and 4166 are provided in relation to the left and right printing pressure primary compression springs 4162 and 4163 respectively as means for varying the repulsive force of the compression springs 4162 to 4165, thereby to continuously vary the left and right printing pressure primary comrpession springs 4162 and 4163 in condensation. The left and right printing pressure adjusting screws 5165 and 5166 are interlockingly driven by a common driving mechanism (not shown) respectively through left and right printing pressure adjusting worm wheels 5167 and 5168, thereby to obtain equivalent printing pressure levels. The left and right printing pressure adjusting screws 5165 and 5166 and the printing pressure adjusting worm wheels 5167 and 5168 are fixed to the left and right main frames 180 and 181 respectively through left and right printing pressure adjusting brackets 4169 and 4170. The left and right impression cylinder stoppers 4166 and 4167 and the support shafts for the left and right printing pressure auxiliary compression springs 4164 and 4165 are respectively fixed to the left and right main frames 180 and 181 through the left and right brakets 4171 and 4172 respectively. According to this embodiment, constant printing pressure is previously secured by the left and right printing pressure secondary compression springs 4164 and 4165 while the left and right printing pressure primary compression springs 4162 and 4163 are varied in condensation to adjust the printing pressure, whereby the left and right printing primary compression springs 4162 and 4163 may not be so much strong in force and operation for varying the condensation, i.e., adjustment of the printing pressure is easy.

In order to restrict the range of rotation of the impression cylinder pulse motor 4153 between the separated position and the contact position, a stopper 4175 is mounted on the left eccentric shaft 1105 as shown in FIG. 5D while the variable range of the stopper 4175 is restricted at a prescribed angle by a stopper pin 4176. In order to detect the rotational phase of the impression cylinder pulse motor 4153 within the said range, a separated position photosensor 4177 and a contact position photosensor 4178 are arranged on the left main frame 181 at a prescribed angle while a sensor dog 4179 is mounted on the left eccentric shaft 1105 to act on the photosensor 4177 and 4178, thereby to detect the time when the impression cylinder pulse motor 4153 reaches the rotational phase corresponding to the separated position and the time when the same reaches that corresponding to the contact position.

Structure of Folder

Figure 6A:
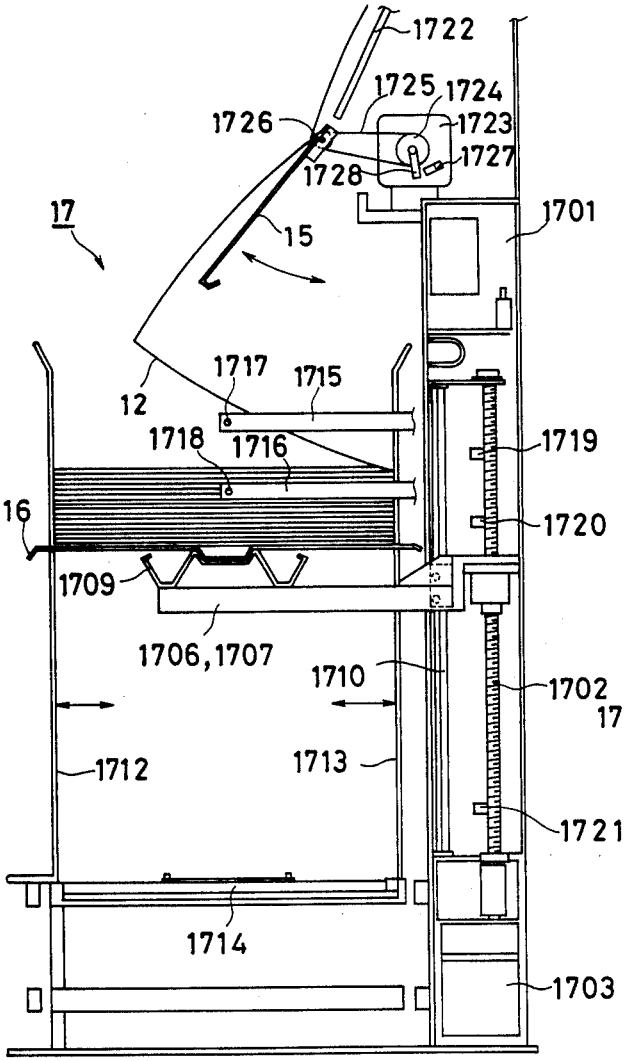
FIGS. 6A to 6D are mechanical explanatory diagrams of a folder.
Figure 6A:
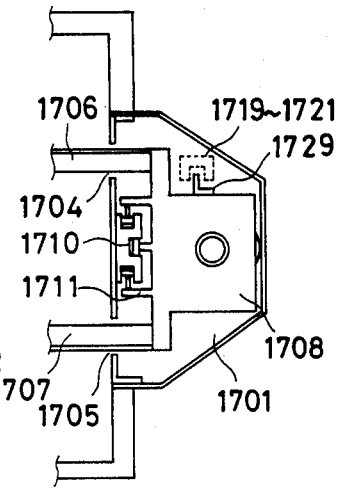
Figure 6B:
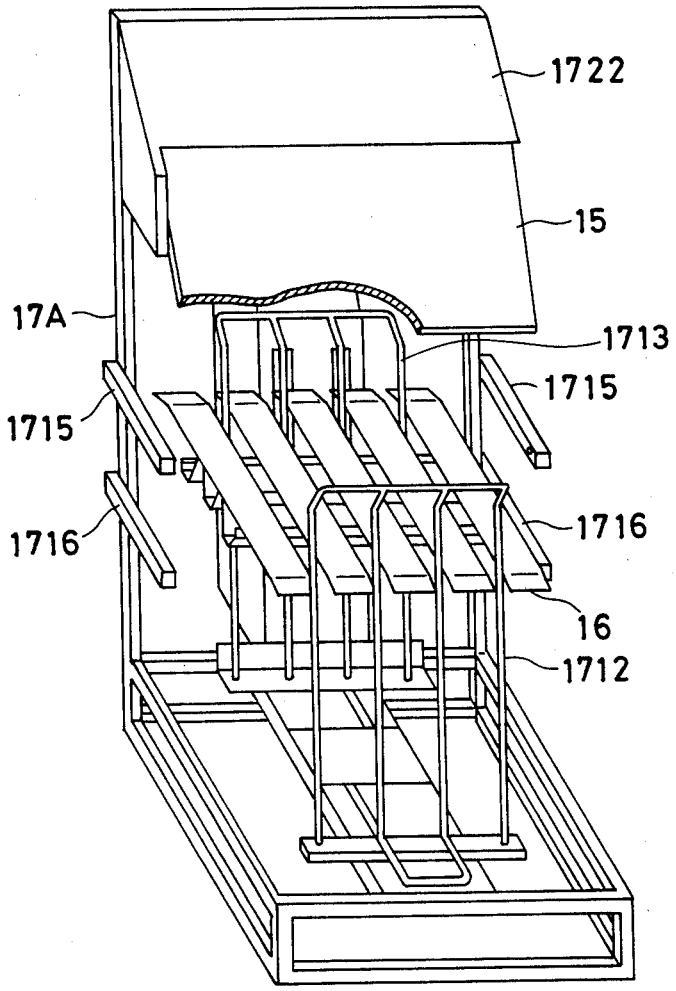

The folder 17 is arranged in front of the printing press body 1 to fold and store the printed continuous paper 12 discharged from the paper conveying system in the aforementioned mechanism. FIGS. 6A(*a*) and (*b*) shows an embodiment of this folder 17, and FIG. 6B is an explanatory perspective view thereof. The folder 17 accordindg to this embodiment is adapted to correctly fold and store the printed continuous paper 12 continuously regardless of the vertical length thereof.

A feed screw 1702 is vertically extended in a rear box 1701 of the folder 17, to be driven by a table elevating motor 1703 placed in the lowermost part of the rear box 1701. The feed screw 1702 engagingly supports a base portion 1708 of a pair of table support members 1706 and 1707 frontwardly extending through two longitudinal openings 1704 and 1705 provided in a parallel manner in the front panel of the rear box 1701, so that the base portion 1708 are vertically moved along rotation of the feed screw 1702 to vertically move a delivery table 16 placed on the support members 1706 and 1707 through a leg portion 1709. In order to facilitate stable movement of the delivery table 16, a guide bar 1710 is extended in parallel with the feed screw 1702 to be engaged with sliding members 1711 provided in front central positions of the base portion 1708.

In order to vary horizontal effective length of the delivery table 16 with the vertical size of the continuous paper 12, a plurality of recesses are defined in front and rear end portions of the delivery table 16 while a plurality of thin rod members vertically extending through the said recesses are connected in the upper and lower positons to define front and rear frmes 1712 and 1713, which are horizontally slidable along a frame retaining portion 1714.

In order to detect the upper plane level of the continuous paper 12 placed on the delivery table 16, light emitting and receiving sides of first and second paper plane detecting photoelectric sensors 1717 and 1718 are arranged in parallel with the table plane in forward ends of horizontal pairs of support members 1715 and 1716 frontwardly extending from a rear body frame 17A of the folder 17 to hold the paper placing part, to shield the continuous paper 12 against light when the upper plane thereof reaches a prescribed level. The first and second paper plane detecting photoelectric sensors 1717 and 1818 are arranged at prescribed levels with reference to the lower end of a paddle 15, so that either the photoelectric sensor 1717 or 1718 is selected in response to the vertical size of the continuous paper 12 in folding operation. The table elevating motor 1703 is driven in response to detection of light shielding, to slightly lower the delivery table 16 thereby to continuously retain the upper plane of the continuous paper 12 at the first or second prescribed level, for facilitating appropriate folding operation in response to the vertical size of the continuous paper 12 with control of the swing angle of a swing guide (paddle) 15 as hereinafter described.

In order to restrict the range of vertical movement of the delivery table 16, first and second table upper limit switches 1719 and 1720 as well as a table lower limit switch 1721 are provided in prescribed positions of the rear box 1701 while a working member 1729 for driving the limit switches 1719, 1720 and 1721 is mounted on a corresponding position of the base portion 1708. The first and second table upper limit switches 1719 and 1720 respectively correspond to the first and second paper plane detecting photoelectric sensors 1717 and 1718, and mounting positions thereof are set in such a manner that, when the delivery table 16 reaches the first or second upper limit position with no paper being placed thereon, the upper surface of the delivery table 16 is slightly lower than the deteceting position of the corresponding one of the first and second paper plane detecting photoelectric sensors 1717 and 1718.

An upper top plate 1722 of the folder 17 is frontwardly inclinedly mounted so that the continuous paper 12 discharged from the printing press body 1 is received on the delivery table 16 slidably along its upper surface. The horizontally movable swing guide (paddle) 15 is provided in the front end of the top plate 1722 while a paddle pulse motor 1723 is arranged in a lower space of the top plate 1722 to rotatingly drive a swing shaft 1726 of the paddle 15 through a timing belt 1725 and a timing pulley 1724, thereby to horizontally swing the paddle 15 at desired timing for folding the continuous paper 12 and piling up the same on the delivery table 16.

The swing angle of the paddle 15 is varied with the vertical size of the continuous paper 12, and a standby position sensor 1727 is provided approximately to the paddle pulse motor 1723 to detect a standby position forming the basis of the range of swing movement of the paddle 15, while a sensor dog 1728 acting on the standby position sensor 1727 is mounted on the rotary shaft of the paddle pulse motor 1723.

Figure 6C:
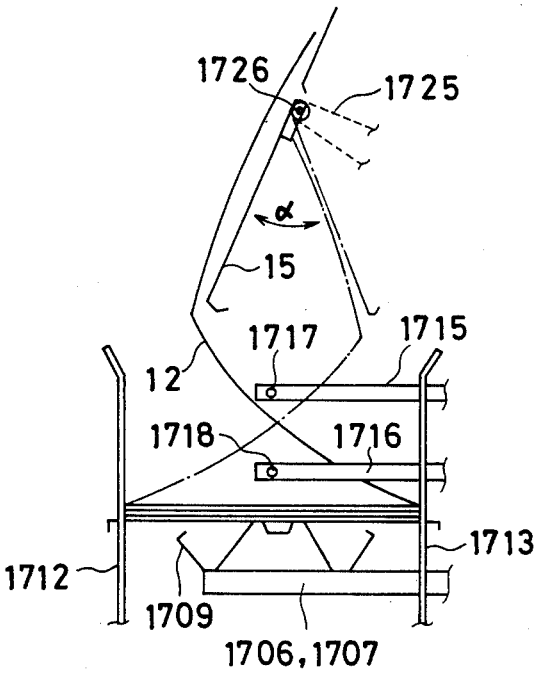
Figure 6D:
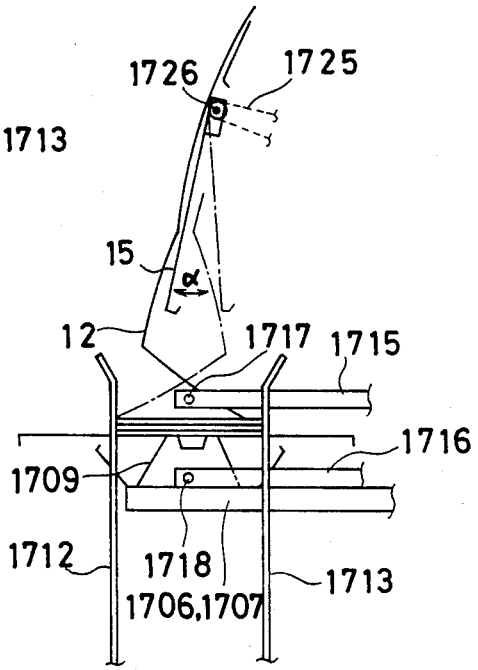

FIGS. 6C and 6D are explanatory diagrams showing examples of setting the swing angle of the paddle 15 and the upper limit position of the delivery table 16 with variation in the vertical size of the continuous paper 12. When the vetical size of the continuous paper 12 is long as shown in FIG. 6C, the swing angle of the paddle 15 is set at a large value while the second upper limit position is selected for the delivery table 16 to define a relatively long interval between the lower end of the paddle 15 and the paper plane on the delivery table 16. When the vertical size of the continuous paper 12 is short as shown in FIG. 6D, the swing angle of the paddle 15 is set at a relatively small value while the first upper limit position is selected for the delivery table 16, to define a relatively short interval between the lower end of the paddle 15 and the paper plane on the delivery table 16. Thus, appropriate folding continuous paper 12. The paper plane detecting sensors 1717 and 1718 and the table upper limit switches 1719 and 1720 may be increased in number in response to the range of the vertical size of the continuous paper 12 to be employed.

Initialization

Description is now made on paper feeding and receiving operations through use of the paper conveying system and the folder in the aforementioned structure. When power is applied, the microprocessor 21 executes initialization sequence to reset the respective mechanical parts at initial positions. In order to initialize the pin feed tractor 13, the microprocessor 21 rotates the DC servo motor 192 in an appropriate number with reference to signals from rotary encoders 196 and 197, to reset the paper feeding pins 1311 at initial positions. In initialization of the suction conveyor 14, energization of the suction blower (not shown) is started while, with respect to the suction force switching solenoids 1418 and 1419, only the solenoid 1419 corresponding to the secondary shutter 1415 is energized, whereby the suction conveyor 14 starts sucking operation in a "medium" state of suction force with the secondary shutter 1415 being open. The conveyor belt 1402 remains stopped.

Figure 7:
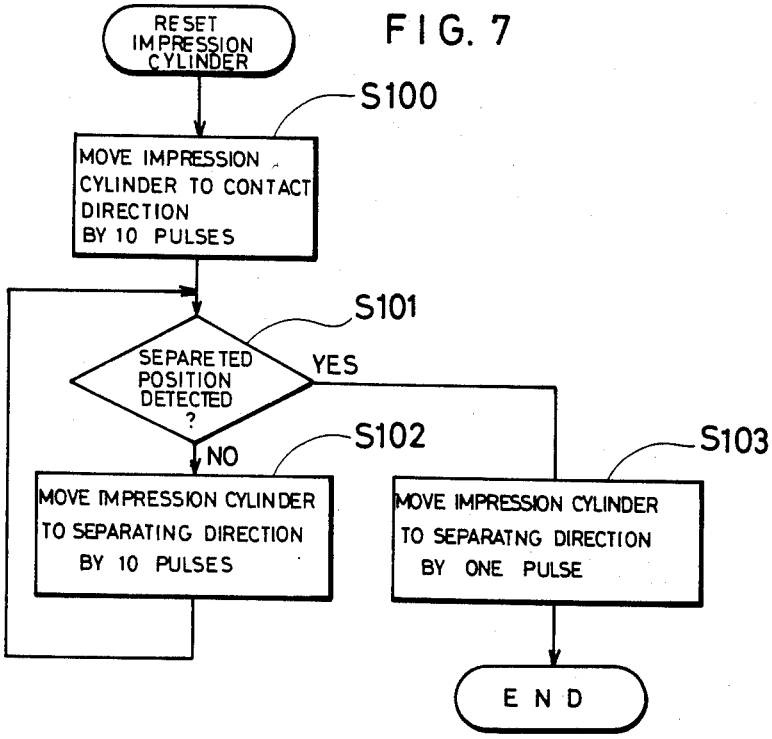
FIG. 7 is a flow chart showing operation for resetting the impression cylinder.

FIG. 7 is a flow chart showing the operation of the microprocessor 21 for resetting the impression cylinder 11 in the separated position. Referring to FIGS. 5 and 7, an impression cylinder shaft being in an arbitrary position is sufficiently rotated in a contact direction so that the sensor dog 4179 is necessarily in a position closer to the contact side than the separated position photosensor 4177 at a step S100. Thus, the eccentric support shaft 1102 is rotated by the impression cylinder pulse motor 4153 in the contact direction to move the impression cylinder 11 in the contact direction by, e.g., about 10 pulses. The angle of rotation in the contact direction is previously set so that the sensor dog 4179 in a separated side stop position (i.e., closest to the separated side) restricted by the stopper 4175 is rotated in the contact side over the separated position photosensor 4177.

At a step S101, a determination is made as to whether or not the separated position photosensor 4177 detects the separated position, and if the determination is of no, the process is advanced to a step S102 to move the impression cylinder 11 further by one pulse in the separated direction. Such operation is kept until the separated position is detected, and then the process is advanced to a step S103. The separated position photosensor 4177 has already been driven at this time, whereas the impression cylinder 11 is moved further by one pulse in the separated direction, in order to ensure the operation. The impression cylinder 11 is always reset in a prescribed separated position by the aforementioned algorithm.

The impression cylinder pulse motor 4153 is stopped in a correct step stop position, whereby the operation of the impression cylinder pulse motor 4153 is ensured thereafter so that the rotational phase of the impression cylinder pulse motor 4153, i.e., the contact/separated positions of the impression cylinder 11 can be correctly detected by merely counting driving pulses, to simplify contact/separation control of the impression cylinder 11 with respect to the blanket cylinder 2. When, for example, rotation of the impression cylinder pulse motor 4153 is forcibly prevented by a rotation preventing mechanism such as a stopper to process the stopped position as a separated position, the separated position of the impression cylinder 11 is always reset in a prescribed position. However, the impression cylinder pulse motor 153 is not necessarily stopped in a correct step stop position, i.e., the same may be stopped in a position between steps, and the operation thereafter is instabilized in such case, whereby it is difficult to correctly detect the rotational phase of the impression cylinder pulse motor 4153 by merely counting the driving pulses. Thus, in view of facilitation of contact/separation control for the impression cylinder 11 with respect to the blanket cylinder 2 with simple structure, the method for resetting the separated position by the aforementioned algorithm employing the separated position photosensor 4177 is effective.

Figure 8:
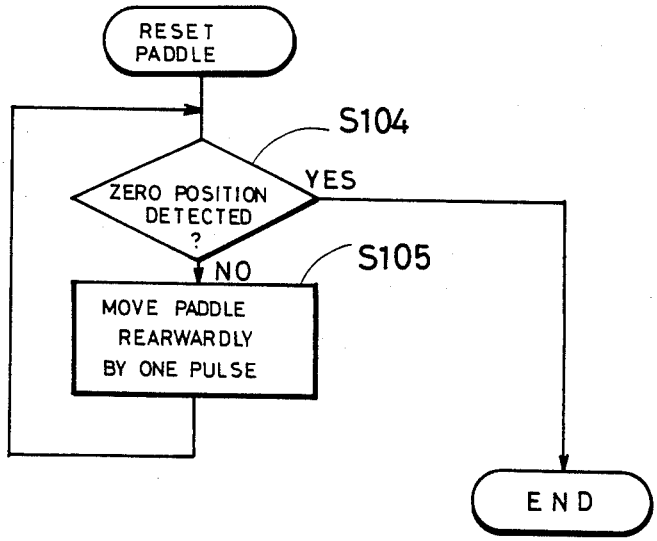
FIG. 8 is a flow chart showing operation for resetting a paddle.

FIG. 8 is a flow chart showing the operation of the microprocessor 21 for resetting the paddle 15 in a zero position. At a step S104, a determination is made as to whether or not the standby position sensor (zero position sensor) 1727 detects the zero position, and if the determination is of no, the process is advanced to a step S105 to rearwardly move the paddle 15 by one pulse by the paddle pulse motor 1723. This operation is kept until the zero position is detected, to complete initialization of the paddle 15 upon detection.

Setting of Continuous Paper

In preparation for printing, the operator sets the continuous paper 12 on the pin feed tractor 13 and inputs vertical size data of the set continuous paper 12 and peak/valley data representing peak folding/valley folding of paper ends through the operation panel 25. In setting of the continuous paper 12, the operator opens the paper pressing lids 1312 of the left and right tractors while rotating the lever 1306 in a loosening direction, i.e., in the clockwise direction to release the right tractor unit 1302 in the moving side to engage the marginal punchholes of the continuous paper 12 with the paper feeding pins 1311 of the left and right tractors while adjusting the horizontal tractor width in correspondence to the paper width so that the paper top end is in paper set reference positions. Then the operator rotates the lever 1306 in a tightening direction, i.e., in the unticlockwise direction to lock the right tractor unit 1302 in the moving side while closing the paper pressing lids 1312 and 1313, thereby to complete setting of the continuous paper 12.

Figure 9:
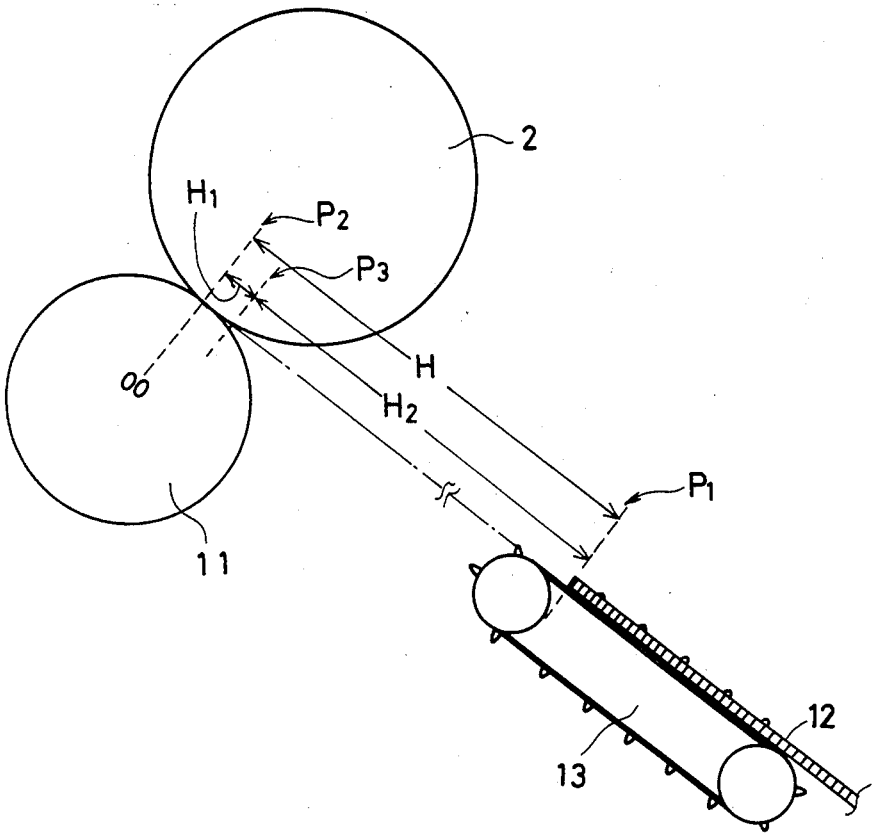
FIG. 9 is an explanatory diagram of a paper end set position.

FIG. 9 is an explanatory diagram showing a paper end setting position of the pin feed tractor 13 for the continuous paper 12. The top end of the continuous paper 12 is always set at the paper set reference position $P_1$ of the pin feed tractor 13 regardless of its vertical size. As hereinabove described, the pin feed tractor 13 is so registered that the paper set reference position $P_1$ is separated by the prescribed interval H from the printing start position $P_2$ and mounted on the printing press body 1, whereby the top end of the continuous paper 12 is before the printing start position P2 by the interval H upon completion of paper setting. When paper passage of the continuous paper 12 thus set is completed or the continuous paper 12 is in a standby state for subsequent printing during the printing process, the fold or machine fold of the continuous paper 12, i.e., the head of a page to be subsequently printed is in a standby position $P_3$ before the printing start position $P_2$ by an approach interval $H_1$. Thus, the positions $P_1$ and $P_3$ respectively form the bases of paper setting and paper feeding in the printing process and must be detectable by an encoder, and hence the interval $H_2$ between $P_1$ and $P_3$ must be set in response to the characteristic of the encoder as employed. When, for example, the minimum unit of detection by the encoder is $\frac{1}{2}$ inch, the interval $H_2$ must be integral times as long as $\frac{1}{2}$ inch. The aforementioned prescribed interval H is obtained by adding the required approach interval $H_1$ to the said interval $H_2$, to decide the mounting position of the pin feed tractor 13. The paper feed pins 1311 of the pin feed tractor 13 are so adjusted that the head of the continuous paper 12 is in the position $P_1$ upon being set with detention of rotation.

Paper Passage Operation

Figure 10:
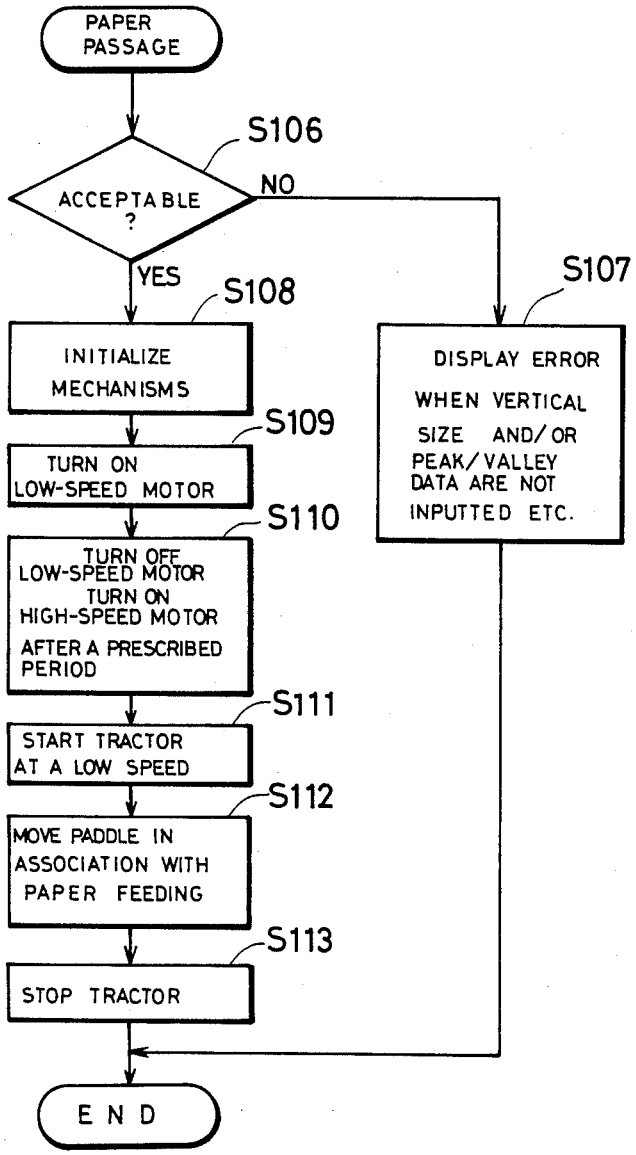
FIG. 10 is a flow chart showing operation for paper passage.

When the continuous paper 12 is set in the pin feed tractor 13, the process is then advanced to paper passage operation. FIG. 10 is a flow chart showing the operation of the microprocessor 21 for executing paper passage sequence. The paper passage is started by putting a paper passage key of the operation panel 25 to work, whereby a determination is made as to whether or not a paper passage command is acceptable at a step S106. When, for example, data on the vertical size of the continuous paper 12 and peak/valley data etc. are not yet inputted and the paper passage sequence cannot be executed, the process is advanced to a step S107 to make error display on the operation panel 25 and complete the operation.

When the paper passage command is acceptable, the process is advanced from the step S106 to a step S108, to initialize the respective mechanical parts. The step S108 is provided for such case where the process is advanced to the paper passage routine from other routine such as washing of the blanket cylinder 2. Thus, when paper passage is executed immediately after power supply, no operation is performed at the step S108 since the respective parts are already initialized in response to the power supply.

Then the main motor 20 is started at steps S109 and S110. The main motor 20 is formed by a low-speed motor and a high-speed motor, so that the low-speed motor is turned on at the step S109 and then the same is turned off after a lapse of a prescribed time while the high-speed motor is turned on at the step S110, to complete starting of the main motor 20. Thus, the driving system by the main motor 20 is so driven that the conveyor belt 140 of the suction conveyer 14 starts conveyance at a prescribed speed while the blanket cylinder 2, the impression cylinder 11, the plate cylinders 3 and 4 and inking rollers in the inking units 7 and 8 start rotation at prescribed speeds. At this time, the impression cylinder 11 is reset in the separated position with respect to the blanket cylinder 2.

Then, at a step S111, the DC servo motor 192 of the pin feed tractor 13 is driven at a low speed and the pin feed tractor 13 starts the paper feeding at a low speed of, e.g., ¼ of that in the printing process. Simultaneously starting of the paper feeding, the microprocessor 21 starts tracking of the paper end position of the continuous paper 12 on the basis of a hard wear timer contained therein. Then the microprocessor 21 moves the paddle 15 in association with the paper feeding as hereinafter described to set the paper end on the delivery table 16 at a step S112, and then the process is advanced to a step S113 to stop the continuous paper 12 by stopping driving of the DC servo motor 192 of the pin feed tractor 13, thereby to complete the paper passage.

Figure 11:
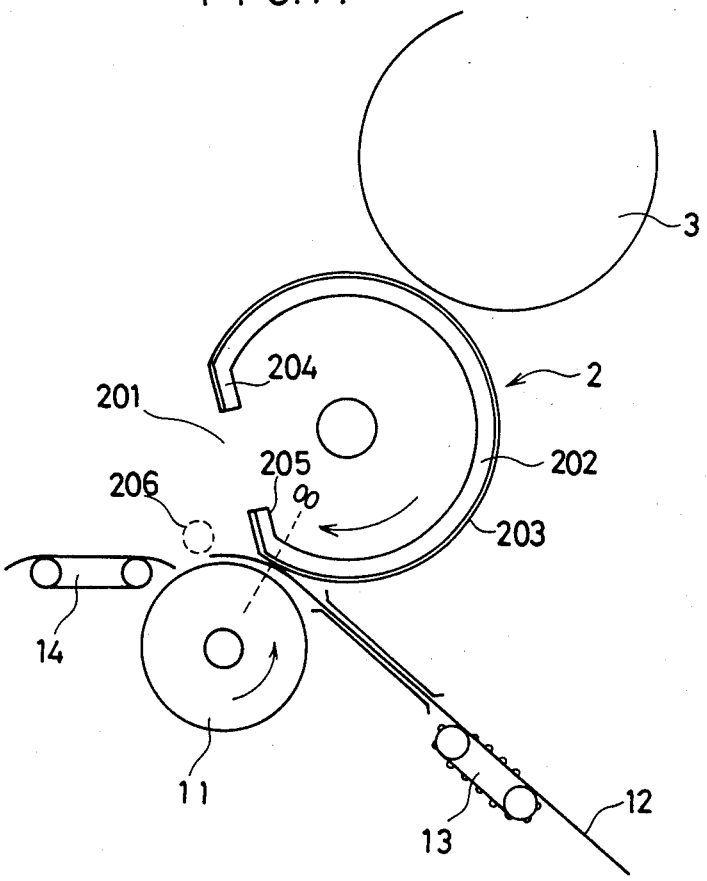
FIG. 11 is an explanatory diagram of paper passage through a clearance between the blanket cylinder and the impression cylinder.

FIG. 11 is an explanatory diagram showing the case of inserting the continuous paper 12 between the blanket cylinder 2 and the impression cylinder 11. The blanket cylinder 2 is formed by closely winding a sheet member 203 on the side surface of a blanket cylinder body 202 having an opening 201, and both ends of the sheet member 203 are fixed to end portions 204 and 205 of the opening 201 by a number of set screws (not shown) provided in the longitudinal direction. The blanket cylinder 2 is driven by the main motor 20 to rotate at a constant speed of, e.g., 4500 rpH while the impression cylinder 11 to be in contact with the blanket cylinder 2 is driven by the blanket cylinder 2 through gears engaged in single end sides thereof to rotate at a speed responsive to the cylinder diameter ratio of the impression cylinder 11 to the blanket cylinder 2.

The impression cylinder 11 is reset in the separated position with respect to the blanket cylinder 2 in response to the power supply, and the paper end of the continuous paper 12 fed by the pin feed tractor 13 passes through a clearance between the blanket cylinder 2 and the impression cylinder 11. The paper feeding speed for the continuous paper 12 must be equivalent to the circumferential speed of the blanket cylinder 2 and the impression cylinder 11 in the printing process, whereas the paper feeding speed in the passage of the continuous paper 12 is set at an extremely low speed such as ¼ of that in the printing process, and hence the continuous paper 12 is urged to progress by the blanket cylinder 2 and the impression cylinder 11 while being in contact with the impression cylinder 11 by its own weight to be fed toward the suction conveyer 14 by the rotation thereof.

If the continuous paper 12 is fed at a speed identical to or faster than the circumferential speed of the blanket cylinder 2, the continuous paper 12 will enter the opening 201 of the blanket cylinder 2 unless the locus of the paper end and the phase of the blanket cylinder 2 are strictly controlled. Further, when a delivery roller 206 is provided as shown by the phantom line to separate the continuous paper 12 from the blanket cylinder 2 in the printing process, the forward end of the continuous paper 12 will be crushed by running against the delivery roller 206. Thus, it is extremely important to make the paper feeding speed for the continuous paper 12 slower than the circumferential speed of the blanket cylinder 2 in paper passage, in order to enable automatic paper passage without performing any complicated control and without crushing the paper end of the continuous paper 12 even if the delivery roller 206 is provided.

The continuous paper 12 thus passed through the clearance between the blanket cylinder 2 and the impression cylinder 11 is guided toward the folder 17 by the suction conveyer 14. The conveyance speed of the conveyer belt 1402 of the suction conveyer 14 is previously set at an appropriate constant value faster than the paper feeding speed in the printing process. Since the current paper feeding speed is ¼ of that in the printing process, the continuous paper 12 is conveyed with tension applied by the suction conveyer 14. Such tension is varied with the suction force of the suction conveyer 14, while the tension is applied to the marginal punchholes of the continuous paper 12 engaged with the paper feeding pins 1311 of the pin feed tractor 13 in paper passage, and hence the suction force is set at the "medium" stage to prevent the marginal punchholes from breakage. As hereinabove described, the primary shutter 1414 of the suction conveyer 14 is in a "closed" state and the secondary shutter 1415 is in an "open" state in the initialization sequence upon power supply, to start medium sucking.

Position Setting of Paddle and Delivery Table

Figure 12:
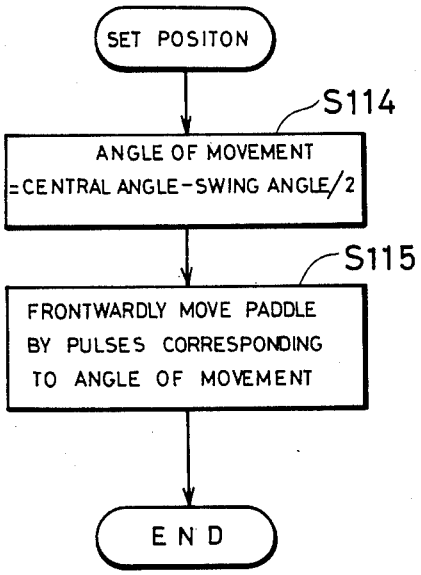
FIG. 12 is a flow chart showing operation for setting the paddle in position.
Figure 13:
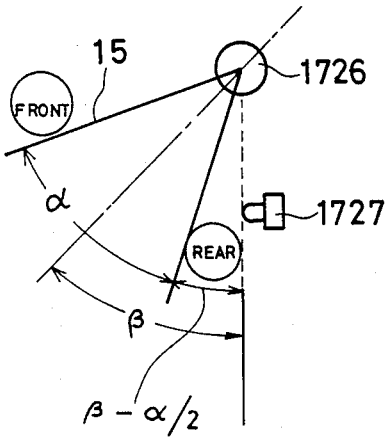
FIG. 13 is an explanatory diagram typically showing set position and swinging angle of the paddle.

In response to the application of power to the paper passage key of the operation panel 25, the paddle 15 and the delivery table 16 of the folder 17 are set in prescribed positions. FIG. 12 is a flow chart showing the operation of the microprocessor 21 for setting the paddle position, and FIG. 13 is an explanatory diagram typically showing the set position and swing angle of the paddle 15. The swing angle $\alpha$ is varied with the vertical size of the continuous paper 12, and the microprocessor 21 sets a count value corresponding to, e.g., a required swing angle $\alpha$ in a counter (not shown) on the basis of vertical size data inputted through the operation panel 25. The paddle 15 is swung between a "front" position and a "rear" position about a position separated by a central angle $\beta$ from a reset position, and upon application of power to the paper passage key, the microcomputer 21 operates $\beta$-$\alpha/2$ at a step S114. This angle is required to move the paddle 15 from the reset position to the "rear" position, and the microprocessor 21 drives the paddle pulse motor 1723 by pulses corresponding to the operated angle at a step S115 to move the paddle 15 to the "rear" position, thereby to complete setting of the paddle 15 in the initial position.

Figure 14A:
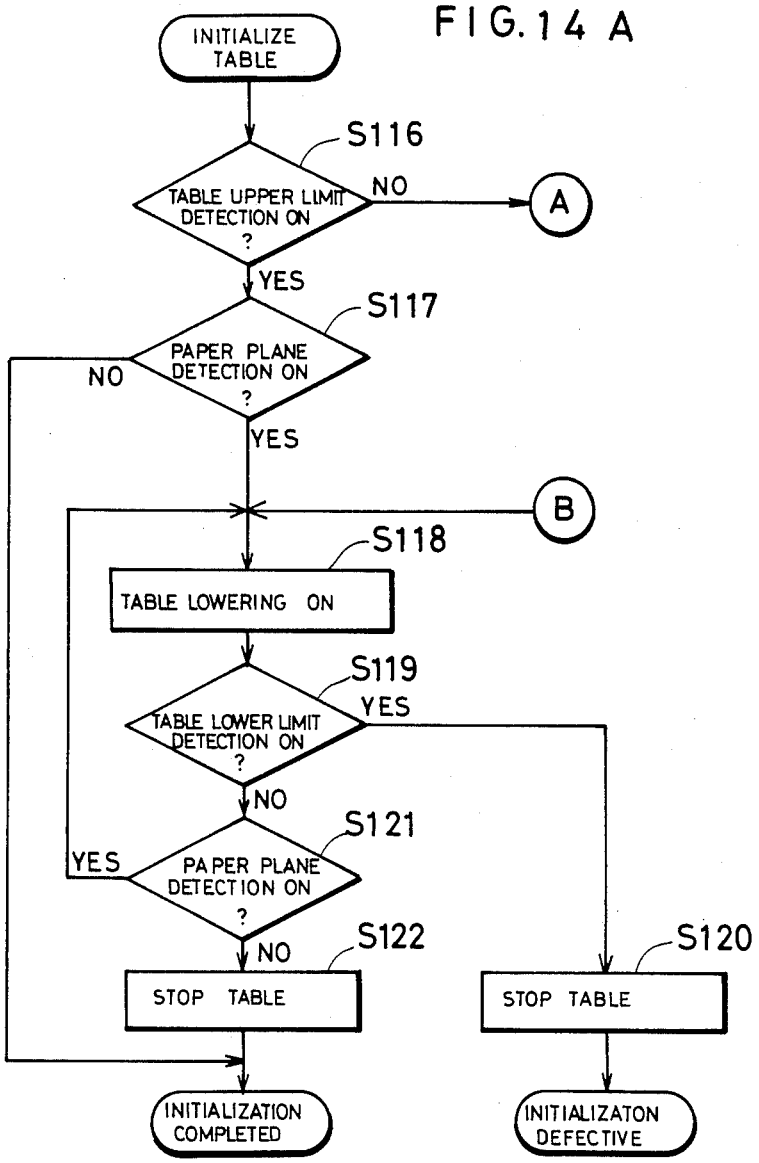
FIGS. 14A–14B are flow charts showing operations for setting a delivery table in an initial position.
Figure 14B:
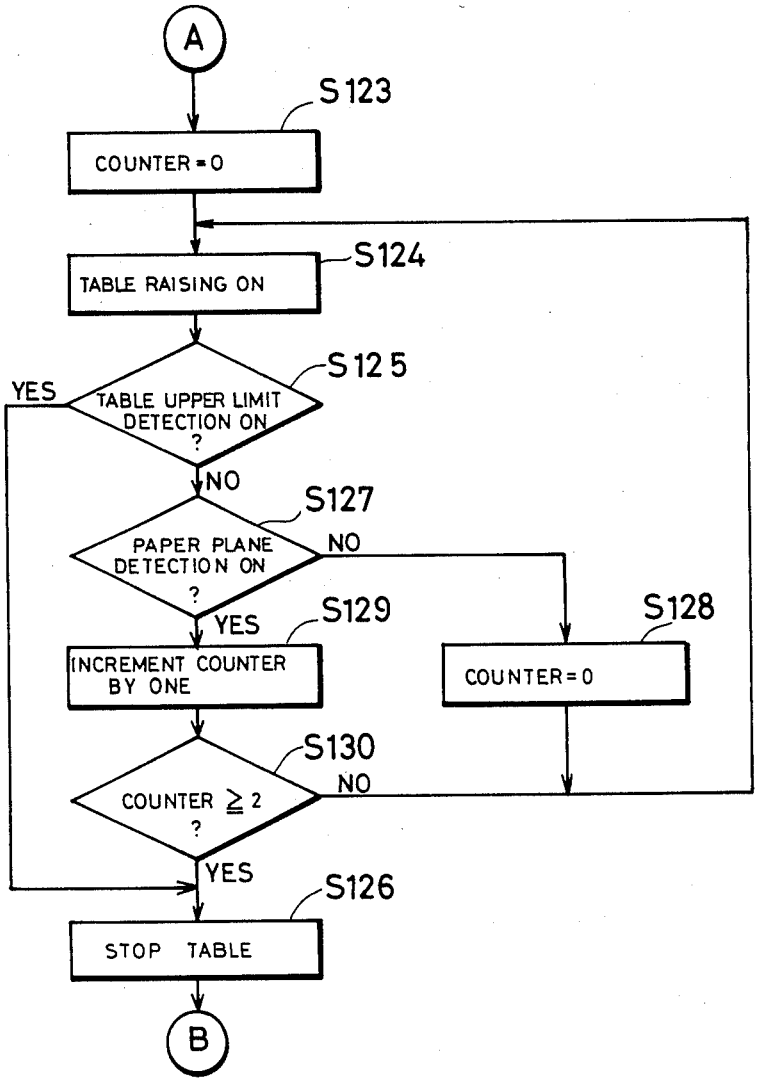
Figure 15A:
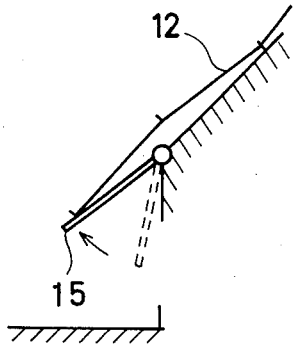
FIGS. 15A–15H are explanatory diagrams typically showing the manner of paper end setting.
Figure 15B:
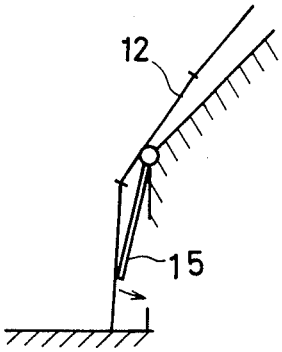
Figure 15C:
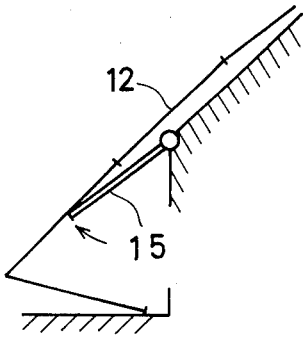
Figure 15D:
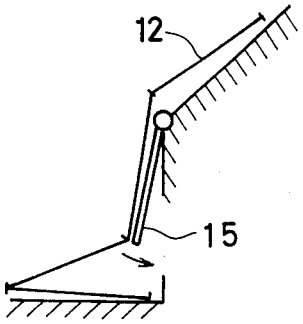
Figure 15E:
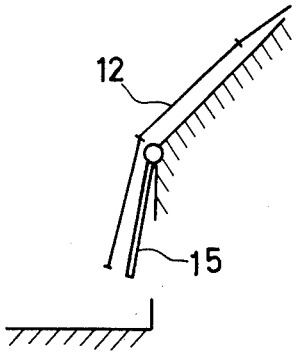
Figure 15F:
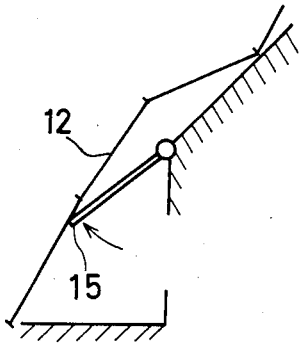
Figure 15G:
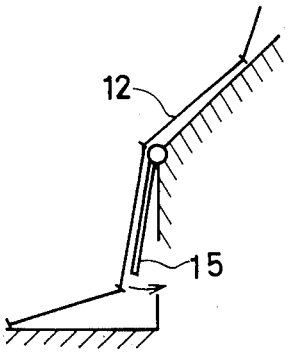
Figure 15H:
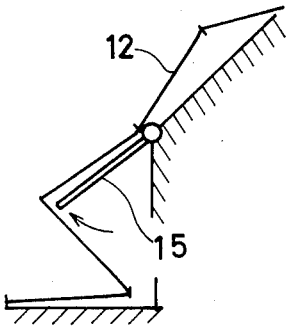

FIG. 14 is a flow chart showing the operation of the microprocessor 21 for setting the delivery table 16 in an initial position. The upper limit position of the delivery table 16 is varied with the vertical size of the continuous paper 12, and the microprocessor 21 selects one of two upper limit positions (those corresponding to the first and second table upper limit switches 1719 and 1720) on the basis of the vertical size data inputted through the operation panel 25. It is assumed here that the first upper limit position corresponding to the first table upper limit switch 1719 is selected for convenience of illustration. Upon application of power to the paper passage key, a determination is made at a step S116 as to whether or not the output of the first table upper limit switch 1719 is ON, i.e., whether or not the delivery table 16 is in the upper limit position, and if the determination is of yes, the process is advanced to a step S117 to determine whether or not the output of the first paper plane detecting photoelectric sensor 1717 is ON, i.e., whether or not 2 paper in preceding printing process remains on the delivery table 16. If no paper remains on the delivery table 16, the output of the first paper plane detecting photoelectric sensor 117 is OFF and setting of the table position is completed at this time.

If the paper remains on the delivery table 16, the output of the first paper plane detecting photoelectric sensor 1717 is ON and the process is advanced from the step S117 to a step S118 to drive the table elevating motor 1703, thereby to downwardly move the delivery table 16 by a prescribed level. During the downward movement of the delivery table 16, supervision is performed at a step S119 as to whether or not the output of the table lower limit switch 1721 is ON, i.e., whether or not the delivery table 16 reaches the lower limit position, and if the delivery table 16 reaches the lower limit position, the process is advanced to a step S120 to stop driving of the table elevating motor 1703 to stop the delivery table 16, while performing error display on the operation panel 25.

During the downward movement of the delivery table 16, further, supervision is performed at a step S121 as to whether or not the output of the first paper plane detecting photoelectric sensor 1717 is ON, and if the same is ON, the process is again returned to the step S118 to further downwardly move the delivery table 16, and when the output becomes OFF, the process is advanced to a step S122 to stop the delivery table 16 thereby to stop the setting of the table position. Thus, the upper plane of the paper remaining on the delivery table 16 is set at the prescribed level.

If the output of the first table upper limit switch 1719 is not ON at the step S116, the delivgery table 16 has not yet reached the upper limit position, and hence the process is advanced to a step S123 to reset the counter (not shown) at zero, and then the table elevating motor 1703 is driven at a step S124 to lift up the delivery table 16 by a prescribed level. During the upward movement of the delivery table 16, supervision is performed as to whether or not the output of the first table upper limit switch 1719 is ON, and when the same is ON, the process is advanced to a step S126 to stop the delivery table 16, to thereafter perform the aforementioned operation of the step S118 and so forth. When no paper remains on the delivery table 16 at this time, the output of the first paper plane detecting photoelectric sensor 1717 is OFF and hence the process is immediately advanced from the step S121 to the step S122 to stop the delivery table 16. When the paper remains on the delivery table 16, the delivery table 16 is stopped when the upper plane of the remaining paper reaches the prescribed level by the aforementioned operation.

During upward movement of the delivery table 16, further, supervision is performed at a step S127 as to whether or not the output of the first paper plane detecting photoelectric sensor 1717 is ON, and if the determination is of no, the process is advanced to a step S128 to reset the counter at zero and then again returned to the step S124 to upwardly move the delivery table 16. When the said output is ON, the process is advanced to a step S129 to increment the counter by one and then a determination is made at a step S130 as to whether or not the count value of the counter exceeds two. At this step S130, a determination is made as to whether or not the ON output of the paper plane detecting photoelectric sensor 1717 is continuously obtained, and hence, if the count value of the counter exceeds two, the paper plane is continuously detected by two or more times and a determination is made that the detection is not erroneous and the process is advanced to the step S126 to stop the delivery table 16. And then the aforementioned operation of the step S118 and so forth are performed, thereby to set the upper plane of the paper remaining on the delivery table 16 at the prescribed level.

When the count value of the counter is one at the step S130, for example, the first paper plane detecting photoelectric sensor 1717 may have detected a slant portion of the remaining paper passed in the printing press body 1 from the paddle 15 to the delivery table 16, and hence the process is again returned to the step S124 to again upwardly move the delivery table 16, and if the output of the first plane detecting photoelectric sensor 1717 is again ON, the process is advanced to the step S126 and so forth as hereinabove described, to set the upper plane of the remaining paper at the prescribed level.

Setting of Paper End

As hereinabove described, the paddle 15 is set in the "rear" position in response to the application of power to the paper passage key of the operation panel 25 and the delivery table 16 or the upper plane of the paper remaining on the delivery table 16 is set at the prescribed level, to receive the continuous paper 12 fed by the pin feed tractor 13 and the suction conveyer 14. FIG. 15 is an explanatory diagram typically showing the manner of paper end setting upon reaching of the forward end of the continuous paper 12 to the folder 17, wherein (a) to (d) show the case of "valley" folding of the paper head and (e) to (e) show the case of "peak" folding of the paper head.

As hereinabove described, the microprocessor 21 tracks the paper end position simultaneously with the starting of paper feeding, and when the peak/valley data inputted through the operation panel 25 is about "valley", the microprocessor 21 drives the paddle pulse motor 1723 before the paper end reaches the folder 17 and after the paddle 15 is completely set in the initial position to swing up the paddle 15 to the "front" position. The microprocessor 21 moves the paddle 15 in the "rear" position at such timing that the paper head is conveyed to a position as shown at FIG. 15(*a*), i.e., slightly ahead of the forward end of the paddle 15. At this time, the first page of the continuous paper 12 is moved to the "rear" position following the paddle 15 through an air current in the rear surface of the paddle 15 backwardly moved to the "rear" position. In order to avoid influence by wind pressure for returning the continuous paper 12 to the "front" position, the width of the paddle 15 is preferably wider than that of the continuous paper 12. Then the continuous paper 12 enters the state as shown at (b). Thereafter the paddle 15 is successively swung between the "front" position and the "rear" position at such timing as shown at (c) and (d) where the continuous paper 12 progresses substantially page by page, and the paper end setting is completed in the state as shown at (d).

When the head of the continuous paper 12 is folded in a "peak" manner, the operation of the paddle 15 is inverted. In other words, the microprocessor 21 will not drive the paddle 15 till the timing as shown at FIG. 15 (*e*), but maintains the same being set at the "rear" position. Then the microprocessor 21 drives the paddle pulse motor 1723 at the timing (e) to move the paddle 15 from the "rear" position to the "front" position. Then the continuous paper 12 enters the state as shown at (f). Thereafter, the paddle 15 is successively swung between the "rear" position and the "front" position at the timing as shown at (g) and (h) where the continuous paper 12 progresses substantially page by page, and the paper end setting is completed in the state as shown at (h).

Figure 16:
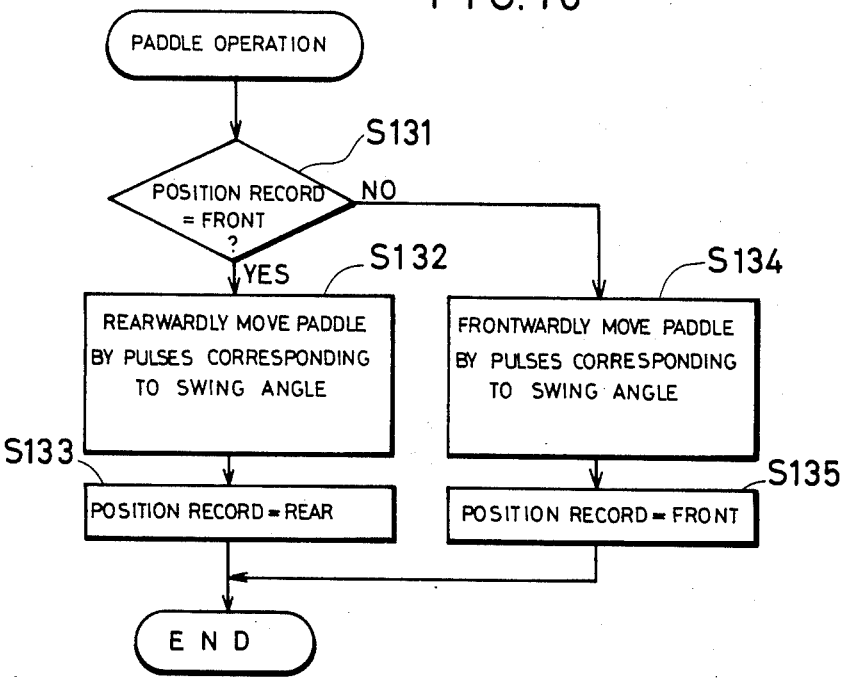
FIG. 16 is a flow chart showing operation for swinging the paddle.

FIG. 16 is a flow chart showing the operation of the microprocessor 21 for driving the paddle 15. This program is called and executed at appropriate timing, and such timing may be based on, e.g., the hard timer contained in the microprocessor 21 or an output signal from a reference rotary encoder 31 (FIG. 17) mounted on the rotary shaft of the blanket cylinder 2. In order to move the paddle 15, a determination is made at a step S131 as to whether the paddle 15 is currently in the "front" position or in the "rear" position. Such discrimination can be made by setting a flag with respect to, e.g., the "front" position. When the paddle 15 is in the "front" position, the process is advanced to a step S132 to rearwardly drive the paddle pulse motor 1723 by pulses responsive to the count value corresponding to the swing angle set in the counter to move the paddle 15 to the "rear" position, and then the process is advanced to a step S133 to record the position of the paddle 15 as "rear", thereby to complete the operation. When the paddle 15 is currently in the "rear" position, the process is advanced to steps S134 and S135 from the step S131, to frontwardly move the paddle 15 through operation similar to the above.

Printing

When the paper passage is completed and the paper end of the continuous paper 12 is set in the folder 17 as hereinabove described, the low-speed paper feeding is stopped, i.e., the DC servo motor 192 of the pin feed tractor 13 is stopped and the main motor 20 enters a standby state for a subsequent command while maintaining rotation. At this time, the head (fold or machine fold) of the first page of the continuous paper 12 to be printed is in the prinitng standby position $P_3$ as shown in FIG. 9.

When a printing key of the operation panel 25 is put into work, the process is advanced to a printing program to successively execute respective routines such as plate exchange, blanket cylinder cleaning, first impression, stationary printing and last impression. In response to the application of power to the printing key, the paper pressing fan 30 starts rotation. The paper pressing fan 30 is stopped in response to completion of the printing program or turn-off of the output of the paper detecting limit switch 1318 mounted on the pin feed tractor 13.

In the plate exchange routine, printing plates (not shown) previously placed on the plate feeding/discharging trays 9 and 10 are windingly mounted on the corresponding plate cylinders 3 and 4 through the corresponding plate feeding/discharging units 5 and 6, while old printing plates (not shown) that have been wound on the plate cylinders 3 and 4 are simultaneously discharged on discharging trays of the plate feeding-/discharging trays 9 and 10. In case of monochromatic printing, such plate discharge is performed only on a required side.

In a blanket cylinder cleaning routine, the detergent solution feeding unit 18 supplies a detergent solution to the blanket cylinder 2 at appropriate timing and the wiping unit 19 wipes the detergent solution simultaneously with intermittent supply of the detergent solution, and thereafter the supply of the detergent solution is stopped to perform only the wiping operation, thereby to complete washing of the blanket cylinder 2.

Then, in a first impression routine, actual printing is performed by about two pages while appropriately controlling the timing of contact between the form rollers in the inking units 7 and 8 and the plate cylinders 3 and 4 and the timing of transfer from the plate cylinders 3 and 4 to the blanket cylinder 2 to adjust the volume of ink on the plate cylinders 3 and 4 and the blanket cylinder 2 for approximating printing density to a stationary value, thereby to enter a stationary printing routine.

In the stationary printing routine, the impression cylinder 11 is brought into contact with/separated from the blanket cylinder 2 at appropriate timing matched in phase with the blanket cylinder 2 so that the continuous paper 12 is intermittently fed in association with the said timing to perform printing on a page per rotation of the blanket cylinder 2. The number of printing is previously set through the operation panel 25, and when the printing reaches the set number, a last impression routine similar to the aforementioned first impression routine is executed to reduce the ink volume on the blanket cylinder 2 nearly to zero thereby to complete the printing process. Then plate discharging and blanket cylinder cleaning routines are executed and then rotation of the main motor 20 is stopped to complete the printing program, and the system enters a standby state for a subsequent command.

Intermittent Feed Control of Continuous Paper

Figure 17:
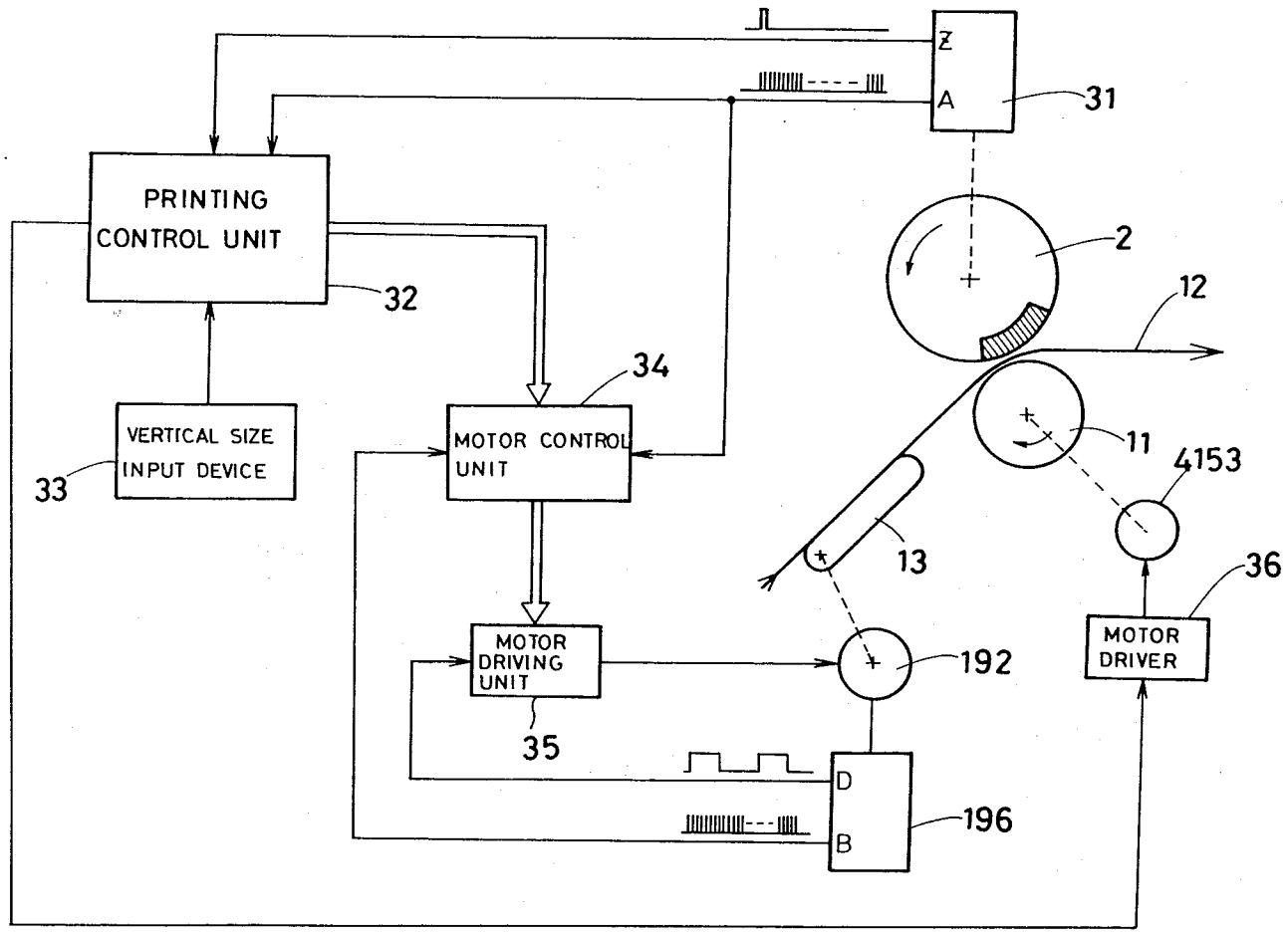
FIG. 17 is a block diagram showing intermittent feed control for the continuous paper.

FIG. 17 is a control block diagram for intermittently feeding the continuous paper 12 in the stationary printing process. The entire control system of this printing press is hereinabove described with reference to FIG. 2, and FIG. 17 particularly shows only the system for controlling intermittent feeding of the continuous paper 12 in detail. In order to recognize reference timing required for the intermittent feed control and other control, a reference rotary encoder 31 is connected to the rotary shaft of the blanket cylinder 2 to derive a Z signal of one pulse per rotation of the blanket cylinder 2 and an A signal of, e.g., 240 pulse/inch (ppi) on the circumference of the blanket cylinder 2. The timing reference signals Z and A are supplied to a printing control unit 32.

On the other hand, a vertical size input device 33 is provided as a part of the operation panel 25 (FIG. 2) for example, to fetch the data on the vertical size of the continuous paper 12 as hereinabove described. A data signal representing the vertical size data is supplied to the printing control unit 32. On the basis of the timing reference signals Z and A and the vertical size data signal, the printing control unit 32 calculates the timing required for controlling intermittent feeding of the continuous paper 12, to provide a required timing command signal to the motor control unit 34 and a motor driver 36 of the impression cylinder pulse motor 4153. In response to the timing command signal from the printing control unit 32, the motor drive 36 drives the impression cylinder pulse motor 4153 to bring the impression cylinder 11 into contact with/separated from the blanket cylinder 2.

As hereinabove described, the DC servo motor 192 for driving the pin feed tractor 13 is provided with the rotary encoder 196 (FIG. 3A), which derives a B signal of, e.g., 240 ppi with respect to paper feeding strength and a D signal of 2 ppi. The motor control unit 34 receives the A signal from the reference rotary encoder 31 in the blanket cylinder 2 side and the B signal from the rotary encoder 196 in the pin feed tractor 13 side and continuously compares the same to output a driving signal to a motor driving unit 35. The timing for starting/stopping the operation of the motor control unit 34 is instructed by the aforementioned timing command signal from the printing control unit 32. The motor driving unit 35 amplifies the said driving signal outputted from the motor control unit 34 to drive the DC servo motor 192. Further, the motor driving unit 35 detects the leading edge of the D signal (outputted per ½ inch of the continuous paper 12, as hereinabove described) from the rotary encoder 196, for controlling a stop (detention) position so that the continuous paper 12 is started from a correct starting position in every page. The stop position is controlled in the unit of ½ inch since the vertical size of the folded continuous paper 12 is generally integral times as long as ½ inch.

Figures 18A, 18B, 18C, 18D, 18E, 18F, 18G:
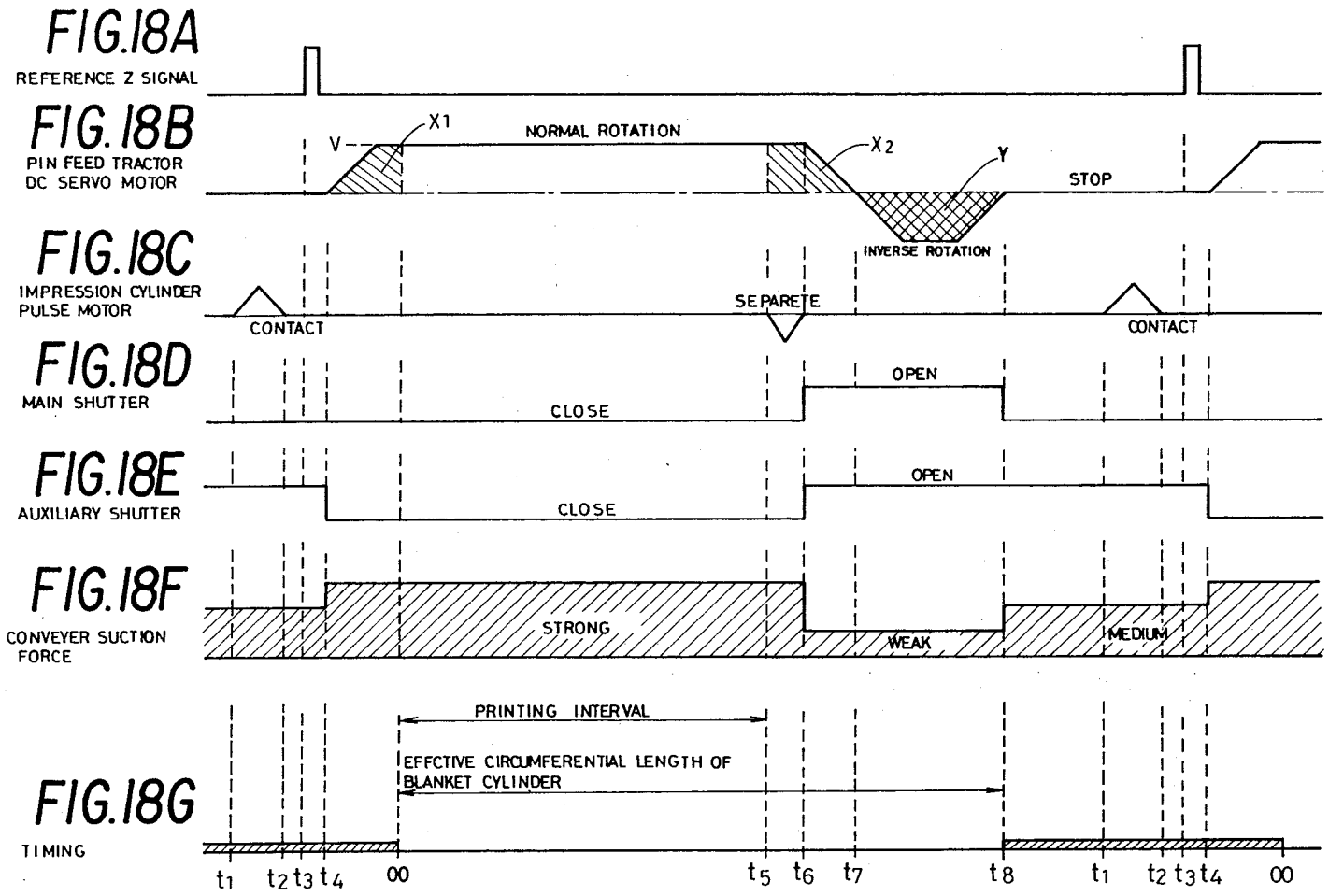
FIGS. 18A–18G are timing charts showing operation for intermittently feeding the continuous paper.

FIG. 18 is a timing chart showing operations of the respective mechanical parts for intermittently feeding the continuous paper 12 in the stationary printing process. As hereinabove described, the output signals Z and A from the reference rotary encoder 31 are employed as timing reference signals. The current phase of the blanket cylinder 2 can be recognized by the output signals Z and A as shown at FIG. 18(*g*). "00" indicates that the top of the blanket cylinder 2 is in the printing starting position, and a terminating end 205 (refer to FIG. 11) of the opening 201 of the blanket cylinder 2 is in the contact position of the blanket cylinder 2 and the impression cylinder 11 at such timing. Slant-line portions at FIG. 18(*g*) show the timing of passage of the opening 201 through the printing starting position, and ¼ of the entire circumferential length of the blanket cylinder 2 is the opening and the remaining ¾ is effective circumferential length of the blanket cylinder 2 in the shown example.

The impression cylinder 11 is brought into contact with the blanket cylinder 2 in an interval between times $t_1$ and $t_2$. As shown at FIG. 18(*c*), the impression cylinder pulse motor 4153 (FIG. 5C) is driven toward the contact side at the time $t_1$ slightly after passage of a beginning end 204 of the opening 201 of the blanket cylinder 2 through the printing start position to gradually accelerate and again gradually slow down the driving, thereby to slowly move the impression cylinder 11 to the contact position in the relatively long interval to the time $t_2$ at which a terminating end 205 of the opening 201 approaches the printing start position. Such driving is performed by supplying a driving command from the printing control unit 32 to the motor driver 36, while the printing control unit 32 recognizes the driving timing by counting the A signal received from the reference rotary encoder 31.

At the time $t_2$ when the impression cylinder 11 reaches the contact position, the opposite blanket cylinder 2 is in the phase of the opening, and hence the continuous paper 12 is not nipped between the blanket cylinder 2 and the impression cylinder 11. The continuous paper 12 is nipped when the terminating end 205 (refer to FIG. 11) of the opening 201 reaches the printing start position, i.e., at the timing of "00", to start the printing process.

When the impression cylinder 11 comes into contact with the blanket cylinder 11, i.e., at the time $t_2$, the DC servo motor 192 of the pin feed tractor 13 is in a non-driven state as shown at FIG. 18(*b*), and the continuous paper 12 is in a printing standby state with stoppage of the pin feed tractor 13. The pin feed tractor 13 is subjected to detention of rotation at a time $t_8$ as hereinafter described, and the head (fold or machine fold) of a first page of the continuous paper 12 to be subsequently printed is in the printing standby position $P_3$ as shown in FIG. 9 at this time. With respect to the suction switching solenoids 1418 and 1419 of the suction conveyer 14, they are in the initial state and only the solenoid 1419 for the secondary shutter is energized as shown at (d) and (e), and hence the primary shutter 1414 is in a "closed" state and the secondary shutter 1415 is in an "open" state while the suction force of the suction conveyer 14 is on the "medium" state as shown at (f). Since the conveyer belt 1402 of the suction conveyor 14 is driven by the main motor 20 to constantly travel in the paper discharging direction, the continuous paper 12 is supplied with appropriate tension between the pin feed tractor 13 and the suction conveyer 14. The suction force in the "medium" stage in the printing standby state is selected to be in a value capable of providing such large tension that the marginal punchholes of the continuous paper 12 engaged with the paper feeding pins 1311 of the pin feed tractor 13 are not broken.

When the reference encoder 31 outputs the Z signal at a time $t_3$ slightly ahead of "00" for starting the printing process as shown at (a), the printing control unit 32 starts counting of the A signal on the basis of the said time $t_3$ to generate a start signal at a count value corresponding to a predetermined timing $t_4$, thereby to supply the same to the motor control unit 34. The motor control unit 34 is activated by the said signal to supply a driving signal for realizing acceleration in accordance with a predetermined speed characteristic to the motor driving unit 35 while comparing the signal A from the reference rotary encoder 31 with the signal B from the rotary encoder 196. The motor driving unit 35 releases the detension at the teime $t_4$ while receiving the above mentioned driving signal to drive the DC servo motor 192, whereby the pin feed tractor 13 is accelerated in a forward rotation direction in accordance with a prescribed speed curve. Simultaneously with driving of the pin feed tractor 13, energization of the solenoid 1419 for the secondary shutter is stopped as shown at (d) to make the secondary shutter 1415 enter a "closed" state and bring the suction force of the suction conveyer 14 into the "strong" state as shown at (e). Thus, feeding of the continuous paper 12 is started with extremely strong tension, and the feeding speed for the forward end of the first page to be printed started from the printing standby position $P_3$ as shown in FIG. 9 reaches a level V identical to the circumferential speed of the blanket cylinder 2 immediately in front of the printing starting position P2 (timing "00"). At the timing of "00" after a moment therefrom, the forward end of the first page reaches the printing start position $P_2$ to be nipped between the blanket cylinder 2 and the impression cylinder 11, and the first page of the continuous paper 12 is subjected to printing in an interval between the timing of "00" and a time $t_5$ when a prescribed printing interval (corresponding to the vertical length of one page) is completed. The distance of movement from the time $t_4$ to "00", i.e., approach distance corresponds to the area of a slant line portion X1 as shown at (b) is controlled by the motor control unit 34 to be always constant.

During the printing process, the continuous paper 12 is nipped by the blanket cylinder 2 and the impression cylinder 11 for conveyance while the paper feeding speed of the pin feed tractor 13 is correctly controlled by the motor control unit 34. The paper feeding speed at this time is preferably slightly faster by, e.g., about 0.2% than the speed for conveying the continuous paper 12 nipped between the blanket cylinder 2 and the impression cylinder 11, i.e., the surface speed of the blanket cylinder 2, so that the continuous paper 12 is safely fed without being torn. As hereinabove described, the continuous paper 12 is supplied with extremely strong tension by the suction force in the "strong" stage during the printing process, whereby the continuous paper sticked to the blanket cylinder 2 by viscosity of the ink can be easily separated from the same. Thus, there is no need to provide a delivery roller 206 as shown by the phantom line in FIG. 11, particularly effectively in case of performing printing over the entire width of the continuous paper 12.

At the time $t_5$ when the printing interval is terminated, the printing control unit 32 supplies a separation command signal to the motor driver 36, to start driving of the impression cylinder pulse motor 4153 in the separated side as shown at (c). The time $t_5$ can be correctly recognized by counting the signal A of the reference rotary encoder 31 by a prescribed number responsive to the vertical size. Dissimilarly to the case of contact, the signal is made to quickly rise and fall in a relatively short interval to achieve quick separation. At a time $t_6$ when the impression cylinder 11 is returned to the separated position, which time $t_6$ can be recognized by counting the signal A similarly to $t_5$ (this also applies to $t_6$ to $t_8$ as hereinafter described), the printing control unit 32 outputs a stop command signal to the motor control unit 34. In response to the stop command signal, the motor control unit 34 supplies a driving signal for achieving deceleration in accordance with a predetermined speed characteristic to the motor driving unit 35 while comparing the signal A from the reference rotary encoder 31 with the signal B from the rotary encoder 196. The motor driving unit 35 receives the driving signal to decelerate the DC servo motor 192, whereby the pin feed tractor 13 is decelerated along a prescribed speed curve as shown at (b). The amount of overrun of the continuous paper 12 caused before the pin feed tractor 13 is completely stopped is represented by the area of a slant line portion X2. In this case, the primary shutter solenoid 1418 and the secondary shutter solenoid 1419 of the suction conveyer 14 are commonly energized at the time $t_6$ as shown at (d) and (e), to commonly open the primary shutter 1414 and the secondary shutter 1415 and reduce the suction force to the "weak" stage as shown at (f), thereby to minimize the tension applied on the continuous paper 12.

Then the printing control unit 32 supplies an reverse rotation command signal to the motor control unit 34 at a time $t_7$ when the feeding speed of the pin feed tractor 13 reaches zero. In response to the inverse rotation command signal, the motor control unit 34 supplies a driving signal for realizing reverse rotation in accordance with a predetermined speed characteristic to the motor driving unit 35. The motor driving unit 35 receives the driving signal to inversely drive the DC servo motor 192, whereby the pin feed tractor 13 is inversely rotated along a prescribed inverse rotation speed curve as shown at (b). The amount of reverse rotation at this time corresponds to an area Y which is previously set so that relation $Y=X_1+X_2$ holds. At a time $t_8$ when the reverse rotation is terminated, the head of a next page of the continuous paper 12 is in the printing standby position $P_3$ as shown in FIG. 9. In other words, the continuous paper 12 is returned by a distance corresponding to the approach distance $X_1$ (between $t_4$ and "00") and the overrun distance $X_2$ (between $t_5$ and $t_7$) by reverse feeding in the interval between $t_7$ and $t_8$.

As to the reverse operation, the continuous paper 12 must be returned by Y when printing is made entirely over the vertical size of the continuous paper 12 as hereinabove described, while such reverse rotation is not required when, for example, a printing inhibited area (non-printed region) exceeding the returning distance Y is provided at the head of each page of the continuous paper.

During the inverse feeding, the suction force of the suction conveyer 14 is in the "weak" stage so that no excessive load is applied to the marginal punchholes of the continuous paper 12 engaged with the paper feeding pins 1311 of the pin feed tractor 13, while the paper pressing fan 30 prevents upward separation of the continuous paper 12 from the upper surface of the suction conveyer 14. At the time $t_8$ when the paper feeding is terminated, the primary shutter solenoid 1418 is released from energization to close the primary shutter 1414 as shown at FIG. 18(*d*), and the suction force is switched to the "medium" stage as shown at (f) to be in a standby state for printing of a subsequent page. At the time $t_8$, further, the printing control unit 32 outputs a stop command signal to the motor control driving unit 35, which responsively performs such control (detention) that the head (fold or machine fold) of the subsequent page of the continuous paper 12 is not displaced from the printing standby position $P_3$ in the printing standby state, through the signal D from the rotary encoder 196.

When the vertical size data of the continuous paper 12 inputted from the vertical size input device 33 is varied in the aforementioned printing sequence, the interval between the times "00" and $t_5$ in FIG. 18 may be varied in response thereto. The memory capacity may be saved by making acceleration and deceleration characteristics of the paper feeding in common thereby to expand/contract only the constant speed portion in variation of the vertical size. In the aforementioned embodiment, the paper feeding speed of the pin feed tractor 13 and the contact/separation of the impression cylinder 11 are controlled on the basis of the signals from the reference rotary encoder 31 mounted on the rotary shaft of the blanket cylinder 2, whereby the paper feeding speed of the pin feed tractor 13 and the contact/separation timing of the impression cylinder 11 are varied with variation of the rotation speed of the blanket cylinder 2, to realize excellent printing position accuracy without deviation of the printing position. However, in case where rotation of the blanket cylinder 2 is absolutely constant (e.g., constantly rotated by another control means), the signal A of the reference rotary encoder 31 may be replaced by the output of another stable oscillator such as a crystal oscillator or that of an oscillator employed in the control unit for controlling the rotation of the blanket cylinder 2, to achieve control responsive to the rotational phase of the blanket cylinder 2, similarly to the above embodiment.

The above description has been made on a standard control method of repeating per-page printing. The printing control unit 32 as shown in FIG. 17 is a control unit having an excellent judgement function implemented by, e.g., a microcomputer, and the same can readily realize such control of changing the printing start position and printing every several pages. The printing start position can be changed by changing the start time $t_4$ for the pin feed tractor 13 as shown in FIG. 18. When, for example, skip printing is made on every other page of the continuous paper 12 having relatively small vertical size, control may be so performed that, after a page is completely printed in the sequence as shown in FIG. 18, the head of a subsequent page skipped by one page comes to the printing standby position $P_3$ as shown in FIG. 9 during an interval between separation of the impression cylinder 11 and generation of a subsequent Z signal from the rotary encoder 31. Such control is enabled by simply controlling the pin feed tractor 13 and the contact/separation timing of the impression cylinder 11 by the printing control unit 32. Further, the continuous paper 12 can be fed at a high speed in the skip printing process for example, by controlling the speed of the pin feed tractor 13.

Signal Processing for Improving Printing Position Accuracy

In order to obtain high printing position accuracy in the aforementioned printing press, it is necessary to completely synchronize the rotational phase of the blanket cylinder 2 with the driving timing of the pin feed tractor 13. In other words, the paper feeding speed for the continuous paper 12 must sufficiently correctly follow variation in the rotation speed of the blanket cylinder 2, so that the printing position is not displaced. Thus, the reference rotary encoder 31 is connected to the rotary shaft of the blanket cylinder 2 in the aforementioned embodiment, to derive the signal Z of one pulse per rotation of the blanket cylinder 2 and the signal A of 240 ppi on the circumference of the blanket cylinder 2 along the rotation of the blanket cylinder 2.

However, in order to realize sufficiently high printing accuracy, the signal A is preferably formed by a pulse signal of higher accuracy, such as a signal of one or more pulses per 0.1 mm of the circumference of the blanket cylinder 2. In order to obtain such an signal A, however, required is a rotary encoder having an extremely large number of output pulses, e.g., in the order of several thousands to several ten thousands per rotation. It is difficult to manufacture such an encoder in practice, and even if such an encoder is provided, the blanket cylinder 2, which is largely decelerated by means such as gears in general, cannot be smoothly rotated, whereby the rotary encoder cannot generate pulses in cycles as obtained by calculation. When, in another means, the reference rotary encoder 31 is accelerated through the rotary shaft of the blanket cylinder 2 by gears or belts, the rotation thereof is varied in relatively short cycles by vibration etc. of the gears or belts, and the output thereof is inevitably generated as a signal including excessive frequency variation. When such a signal is adapted to control a motor, particularly a DC motor or the like responsive at a high speed may follow the undesired frequency variation included in the rotary encoder output to further amplify the variation, whereby correct control cannot be performed.

Figure 19:
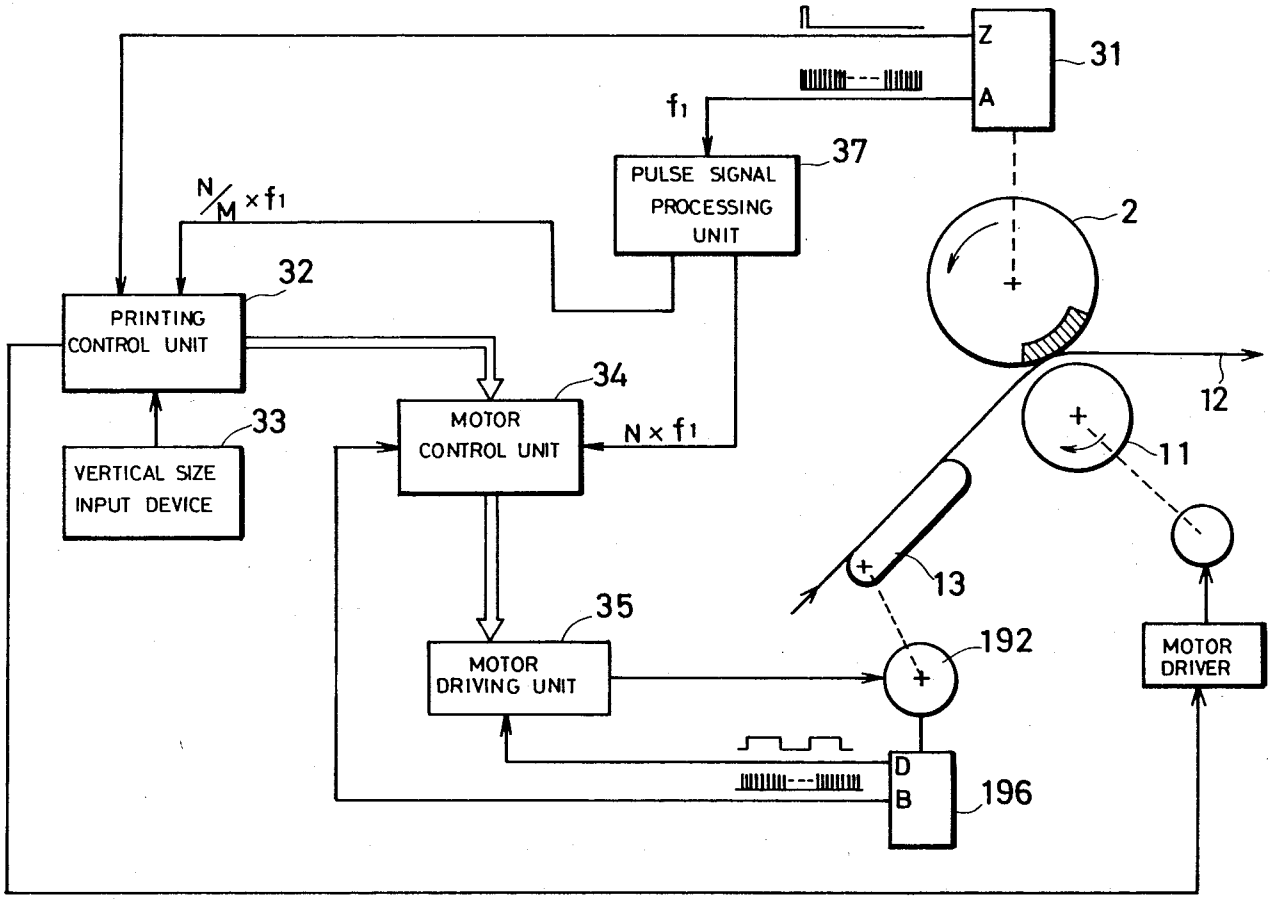
FIG. 19 is a block diagram showing an example of application of a pulse signal processing unit for attaining high printing position accuracy.

In order to solve the aforementioned problem, employed is a pulse signal processing unit which can multiply a pulse signal being small in pulse number, i.e., relatively low in frequency outputted from a pulse signal generator mounted on an object including slight variation in displacement speed such as the blanket cylinder 2 and output as a pulse signal of relatively high frequency including only frequency variation corresponding to the speed variation of the object, to control driving timing of the pin feed tractor 13 by the multiplied pulse signal. FIG. 19 is a control block diagram showing the structure therefor, in which a pulse signal processing unit 37 is added to the structure as shown in FIG. 17. A reference rotary encoder 31 is mounted on the rotary shaft of a blanket cylinder 31 to derive a Z signal of one pulse per rotation of the blanket cylinder 2 and an A signal of 60 pulses per inch of the circumference of the blanket cylinder 2 (i.e., $f_1=60$ pulse/inch (ppi)), along rotation of the blanket cylinder 2.

Within these reference signals, the Z signal is supplied to a printing control unit 32 and the A signal is supplied to the pulse signal processing unit 37. On the basis of the A signal supplied from the reference rotary encoder 31, the pulse signal processing unit 37 generates a signal of $N\times f_1$ (signal of 1920 ppi when $N=32$, for example) required by a motor control unit 34 and a signal of $N/M\times f_1$ (signal of 240 ppi when $N/M=4$, for example) required for a printing control unit 32. The pulse signal processing unit 37 is further adapted to remove variation components of relatively high frequency included in the A signal, which may exert bad influence on control of a DC servo motor 192.

On the basis of the aforementioned Z signal and $N/M\times f_1$ signal, i.e., being reset per Z signal, the printing control unit 32 counts the $N/M\times f_1$ signal to calculate the timing required for intermittently feeding the continuous paper 12, thereby to supply a required timing command signal to the motor control unit 34 and the motor driver 36 of the impression cylinder pulse motor 4153. In response to the timing command signal from the printing control unit 32, the motor driver 36 drives the impression cylinder pulse motor 4153, to make the impression cylinder 11 in contact with/separated from the blanket cylinder 2. The DC servo motor 192 is provided with a rotary encoder 196, which derives the B signal of, e.g., 240 ppi with respect to the paper feed length as hereinabove described and the D signal of 2 ppi. The motor control unit 34 receives the $N\times f_1$ signal and the B signal and continuously compares the same to output a driving signal for realizing a predetermined paper feed speed characteristic to the motor driving unit 35. The timing for starting/stopping the operation of the motor driving unit 34 is instructed by the aforementioned timing command signal from the printing control unit 32. The motor driving unit 35 amplifies the driving signal to drive the DC servo motor 192, whereby the pin feed tractor 13 is driven in accordance with a predetermined speed curve to intermittently feed the continuous paper 12 at prescribed timing. Further, the motor driving unit 35 detects the leading edge of the D signal of the rotary encoder 196 to control the stop (detention) position for starting forwarding of the continuous paper 12 from a correct starting position of every page, as hereinabove described.

In order to improve printing accuracy in the aforementioned intermittent feeding control for the continuous paper 12, the signal as the control timing reference, i.e., the $N\times f_1$ signal and $N/M\times f_1$ signal must sufficiently regenerate slight variation in rotation speed of the blanket cylinder 2. In other words, the signals multiplied by N and N/M respectively in the pulse signal processing unit 37 must correctly reflect frequency variation (preferably limited to that based on variation in rotation speed of the blanket cylinder 2) in the A signal before multiplication.

Figure 20:
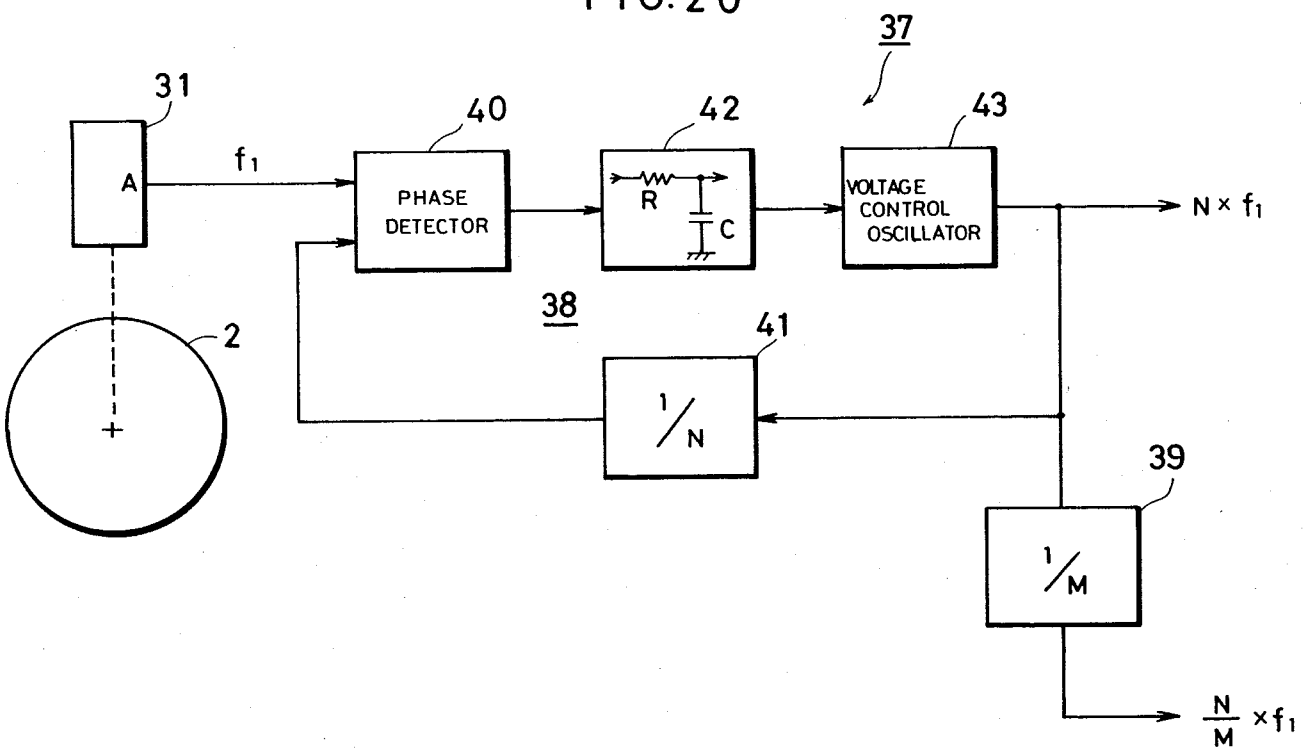
FIG. 20 is a block diagram showing the pulse signal processing unit in detail.

FIG. 20 is a block diagram showing an embodiment of a pulse signal processing circuit 37 for realizing such pulse processing. The pulse signal processing circuit 37 includes a PLL circuit 38, which receives an A signal (frequency f1) from a reference rotary encoder 31 to remove unnecessary frequency variation components from the A signal and multiply the same by N thereby to derive an $N \times f_1$ signal, which in turn is frequency-divided by 1/M through a frequency divider 39, so as to derive an $N/M \times f_1$ signal.

Referring to FIG. 20, the A signal from the reference rotary encoder 31 is supplied to one input of a phase detector 40. The other input of the phase detector 40 is supplied with a signal obtained by frequency-dividing the output signal $N \times f_1$ from the PLL circuit 38 to 1/N by a variable frequency divider 41, in a feedback manner. The phase detector 40 compares the both input signals to perform phase detection, and the output thereof is supplied to a low-pass filter 42 formed by an integration circuit. As hereinafter described, the time constant of the integeration circuit of the low-pass filter 42 is previously set so that relatively high frequency variation components are removed from the A signal and the output signal $N \times f_1$ from the PLL circuit 38 correctly follows relatively low frequency variation components in the A signal.

The output of the low-pass filter 42 is supplied to a voltage control oscillator 43 as a control signal, which in turn oscillates at frequency responsive to the control signal. The oscillation output is frequency-divided by the variable frequency divider 41 and subjected to feedback to the phase detector 40 and compared with the A signal for phase locking, as hereinabove described. When the frequency divisional ratio N of the variable frequency divider 41 is arbitrarily varied in this loop, a pulse signal of relatively high frequency can be arbitrarily obtained from the output signal (A signal) of the reference rotary encoder 31 which is in relatively low frequency.

At this time, the time constant of the integration circuit of the low-pass filter 42 is appropriately selected so as to remove the relatively high frequency variation components included in the A signal of the reference rotary encoder 31, while the output signal of the PLL circuit 38 can correctly follow other frequency variation components, i.e., variation components in the rotation speed of the blanket cylinder 2.

FIG. 21 is an explanatory diagram showing such a manner.

Figure 21A:
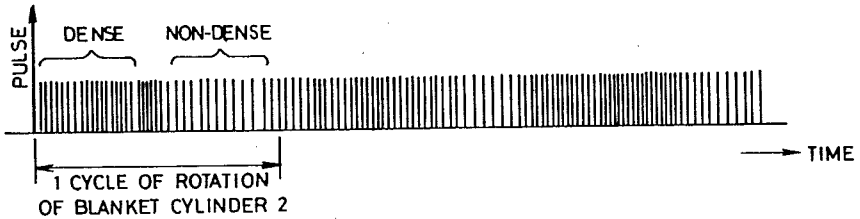
FIGS. 21A–21C are explanatory diagrams showing frequency variation before and after signal processing by the pulse signal processing unit.
Figure 21B:
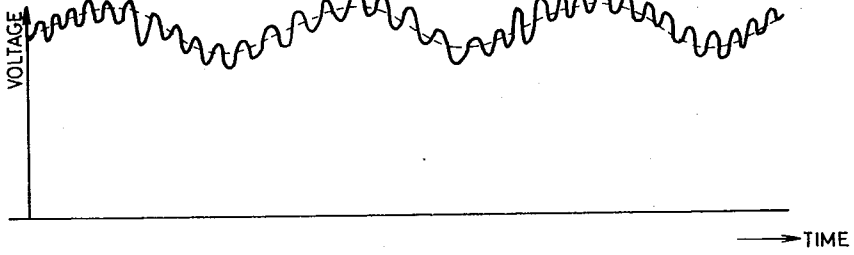

As shown at FIG. 21(A), the A signal outputted from the reference rotary encoder 31 is varied in density with variation in load torque with respect to every rotation of the blanket cylinder 2, while including variation components of higher frequency caused by vibration specific to the mechanism, though not shown in the figure. In order to clearly recognize such frequency variation, the A signal outputted from the rotary encoder 31 as shown at FIG. 21(A) is subjected to frequency-voltage conversion to obtain a voltage waveform as shown at FIG. 21(B). With reference to the voltage waveform, it is understood that the A signal includes both of relatively high frequency variation components and relatively low frequency variation components.

Figure 21C:
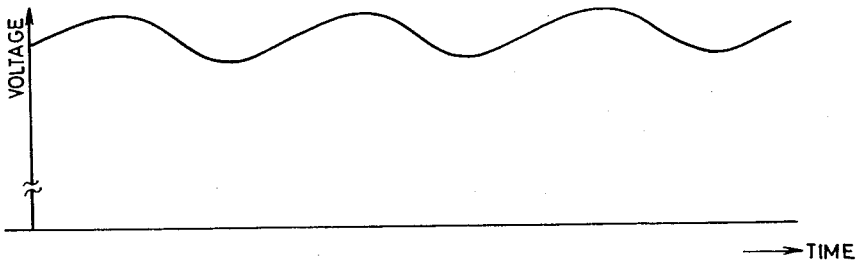

Assuming that the A signal outputted from the reference rotary encoder 31 and the $N \times f_1$ output signal from the pulse signal processing unit 37 are subjected to frequency-voltage conversion respectively by F–V converters while actually driving the printing press and changing the time constant of the low-pass filter 42 while comparing the voltage waveforms, the relation therebetween becomes that as shown at FIG. 21(B) and (C) at a time constant within a given range. Namely, the $N \times f_1$ output signal from the pulse signal processing unit 37 includes absolutely no relatively high frequency variation component at this time as shown at FIG. 21(C), while correctly following the aforementioned relatively low frequency variation components based on the variation in the rotation speed of the blanket cylinder 2. Thus, the time constant of the low-pass filter 42 is set at such a value, thereby to make the paper feed timing for the continuous paper 12 varied correctly following only the variation in the rotation speed of the blanket cylinder 2 in the circuit as shown in FIG. 19.

Serial Lowering of Delivery Table

The continuous paper 12 intermittently fed for printing in the aforementioned manner and discharged from the printing press body 1 is sequentially folded by the folder 17 to be piled up for storage. The microprocessor 21 executes the paddle swinging program as shown in FIG. 16 every time the zero point pulse (Z signal) is outputted from the reference rotary encoder 31 mounted on the rotary shaft of the blanket cylinder 2, to swing the paddle 15 alternately in the "front" and "rear" positions at the swing angle (refer to FIG. 13) responsive to the vertical size of the continuous paper 12 upon completion of printing per page. The operation at this time is similar to that described above with reference to paper passage.

Figure 22:
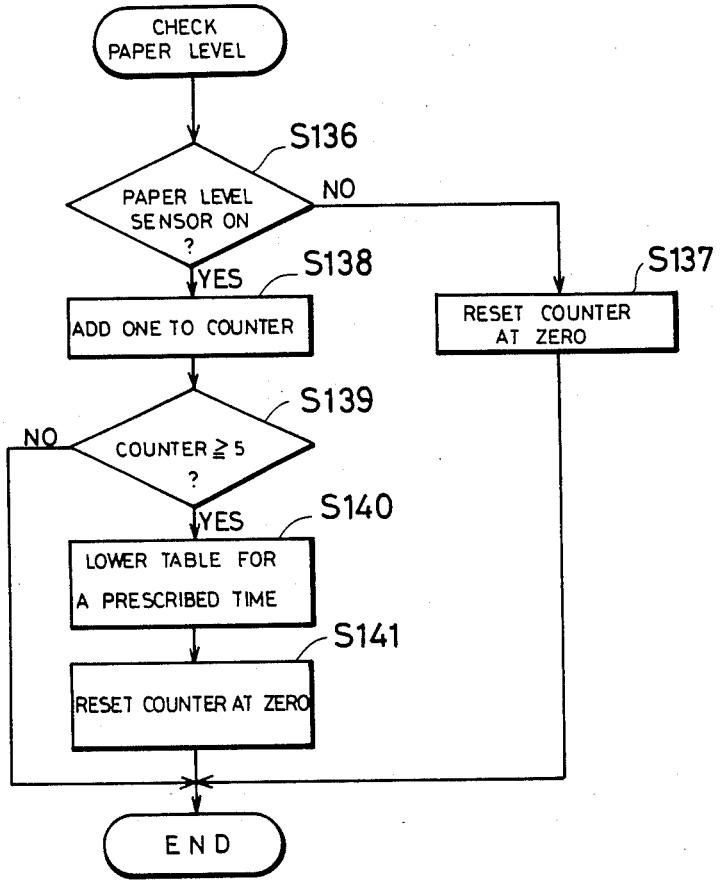
FIG. 22 is a flow chart showing operation for serially lowering the delivery table.

The delivery table 16 is gradually lowered as the continuous paper 12 is piled up. FIG. 22 is a flow chart showing the operation of the microprocessor 21 for lowering the delivery table 16. The microprocessor 21 executes this program every time the aforementioned zero point pulse (Z signal) is outputted from the reference rotary encoder 31 of the blanket cylinder 2. The level of the paper upper plane is selected in response to the vertical size data as hereinabove described with reference to paper passage, and the following description is made on the case where the level of the paper upper plane is selected in correespondence to the first paper plane detecting photoelectric sensor 1717 similarly to the above case.

At a step S136, a determination is made as to whether or not the output of the first paper plane detecting photoelectric sensor 1717 is ON, i.e., whether or not the paper upper plane reaches a prescribed level. If the determination is of no, the process is advanced to a step S137 to reset a counter (not shown) at zero thereby to complete the operation. If the paper upper plane reaches the prescribed level, the output of the first paper plane detecting photoelectric sensor 1717 is ON and the process is advanced from the step S136 to a step S138, to increment the counter by one. Then, at a step S139, a determination is made as to whether or not the count value of the counter exceeds five, i.e., whether or not the output of the first paper plane detecting photoelectric sensor 1717 continuously becomes ON five or more times. Such condition of detection in a plurality of times is so made as to avoid erroneous operation in case where the first paper plane detecting photoelectric sensor 1717 detects the slant portion of the continuous paper 12 hanging from the paddle 15. Namely, the slant portion of the continuous paper 12 will not be detected continuously five or more times since the same is always swung in the horizontal direction.

When the count value of the counter exceeds five, the paper upper plane on the delivery table 16 reaches the prescribed level, whereby the process is advanced from the step S139 to a step S140 to downwardly drive the table elevating motor 1703 for a prescribed period, thereby to lower the delivery table 16 by a prescribed distance (e.g., by 5 mm). Then the counter is reset at zero at a step S141, to terminate the operation. If the count value is less than five, the operation is terminated without lowering the delivery table 16, while the counter is not reset at this time, and the delivery table 16 is lowered when the count value exceeds five in repeated execution of this program thereafter. Thus, the paper upper plane is continuously retained at the level responsive to the vertical size of the continuous paper 12.

Although the apparatus for intermittently feeding continuous paper according to the present invention is applied to an offset printing press having a blanket cylinder in the above description, the present invention is also applicable to a printing press in such a system of employing plate cylinders as transfer cylinders for direct printing, to obtain an effect similar to that of the above embodiment.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An apparatus for intermittently feeding continuous paper to be employed in a printing press for making an impression cylinder in contact with/separated from an oppositely rotating transfer cylinder at prescribed timing by contact/separation means to intermittently feed said continuous paper inserted between said impression cylinder and said transfer cylinder in association with said timing thereby to perform printing on said continuous paper, said apparatus comprising:

paper feeding means arranged on an inlet side of a printing position for forward/reverse feeding and stopping said continuous paper at timing previously set in relation to said timing for contact/separation; and a suction conveyer arranged in an outlet side of said printing position for sucking and conveying printed said continuous paper to a discharge side while switching its suction force in plural stages in relation to said paper feed timing.

2. An apparatus for intermittently feeding continuous paper in accordance with claim 1, wherein said suction force of said suction conveyer is switched to be relatively strong in forward feeding of said continuous paper, relatively weak in reverse feeding of said continuous paper and intermediate therebetween in stoppage of said continuous paper.

3. An apparatus for intermittently feeding continuous paper in accordance with claim 1, wherein a sucking/conveying surface of said suction conveyer is provided entirely over the lateral direction of said continuous paper.

4. An apparatus for intermittently feeding continuous paper in accordance with claim 3, wherein said suction conveyer has a suction width adjusting mechanism for adjusting effective suction width of said sucking/conveying surface in response to paper width of said continuous paper.

5. An apparatus for intermittently feeding continuous paper in accordance with claim 1, wherein the conveyance speed of said suction conveyer is faster than circumferential speeds of said impression and transfer cylinders.

6. An apparatus for intermittently feeding continuous paper in accordance with claim 1, further comprising:

means for generating a reference signal related to the rotational phase of said transfer cylinder, means for inputting vertical size data of said continuous paper, and control means for receiving said reference signal and said vertical size data to drive said contact/separation means by only a rotational phase part corresponding to the vertical size of said continuous paper indicated by said vertical size data on the basis of said rotational phase of said transfer cylinder indicated by said reference signal thereby to make said impression cylinder and transfer cylinder in contact with each other and to drive said paper feeding means in response to said timing of said contact/separation to control the paper feed volume in response to said vertical size of said continuous paper.

7. An apparatus for intermittently feeding continuous paper in accordance with claim 6, wherein said control means drives said paper feeding means in separation of said impression cylinder from said transfer cylinder to advance said continuous paper by prescribed pages without printing, thereby to enable skip printing per prescribed pages.

8. An apparatus for intermittently feeding continuous paper in accordance with claim 1, further comprising blast means arranged on said outlet side of said printing position oppositely to said suction conveyer with interposition of a feeding path for said continuous paper for sending a blast to said continuous paper to push the same against the sucking surface of said suction conveyer.

9. An apparatus for intermittently feeding continuous paper in accordance with claim 1, wherein said continuous paper has marginal punchholes on both side edges thereof and said paper feeding means includes a pin feed tractor, said pin feed tractor comprising:

a first tractor unit formed on a first tractor frame having a reference plane and having a first train of paper feeding pins engaged with said marginal punchholes on one of said side edges of said continuous paper, a second tractor unit formed on a second tractor frame having a reference plane and having a second train of paper feeding pins engaged with said marginal punchholes on the other said side edge of said continuous paper, a driving system for synchronously driving said first and second paper feeding pin trains, and a relatively accurate linear bearing having first and second moving elements having reference planes and a guide rail for guiding said moving elements to slidingly move the same only in a one-dimensional direction, said first and second tractor frames being fixed to said first and second moving elements with said reference planes thereof being in contact with said reference planes of said first and second moving elements in a parallel manner with each other.

10. An apparatus for intermittently feeding continuous paper in accordance with claim 9, wherein said first and second paper feeding pin trains are formed on first and second paper conveyer belts respectively and said driving system comprises:

a driving power supply and a spline shaft rotatingly driven by said driving power supply, first and second bearings engaged with said spline shaft slidably along the longitudinal direction thereof to rotate along rotation of said spline shaft, first and second pulleys freely engaged with said spline shaft, said first and second paper conveyer belts being wound around said first and second pulleys respectively, and fixing means capable of fixing said first bearing and said first pulley as well as said second bearing and said second pulley in such a state that one side surface of said first pulley is in contact with that of said second pulley.

11. An apparatus for intermittently feeding continuous paper in accordance with claim 1, further comprising a restriction member arranged approximately to said transfer cylinder for restricting the position of said continuous paper with respect to said transfer cylinder, said transfer cylinder having an opening, and said paper feeding means feeding said continuous paper into a clearance between said transfer cylinder and said restriction member at a conveyance speed slower than said circumferential speed of said transfer cylinder while rotating said transfer cylinder for inserting said continuous paper in said clearance, thereby to prevent said continuous paper from entering said opening.

12. And apparatus for intermittently feeding continuous paper in accordance with claim 1, further comprising a folder for alternately folding said continuous paper sucked and conveyed by said suction conveyer and discharged in an unfolded state alternately along folding directions of folds thereof, said folder including:

a swing guide arranged along a delivery path for said continuous paper for swinging said continuous paper, swing guide driving means for swinging said swing guide at prescribed timing related to supply of said continuous paper and responsively swinging said continuous paper in directions along folds thereof, a delivery table for receiving said continuous paper swung by said swing guide and dropped thereon to fold and pile up the same, means for serially lowering said delivery table in response to the piled amount of said continuous paper to retain the upper plane of said continuous paper placed on said delivery table at a prescribed level, and means for changing the swing angle of said swing guide and said prescribed level of said upper plane of said continuous paper on said delivery table in response to said vertical size of said continuous paper.

13. An apparatus for intermittently feeding continuous paper in accordance with claim 12, wherein said swing guide is a paddle having a swing support shaft extending in the lateral direction of said continuous paper in the lower surface side of said delivery path for said continuous paper.

14. An apparatus for intermittently feeding continuous paper in accordance with claim 12, further comprising:

a photoelectric detector having a light emitting side and a light receiving side, which are oppositely arranged at a prescribed level with interposition of an elevating path for said delivery table so that the optical axis thereof is in parallel with a table plane of said delivery table and directed to said lateral direction of said continuous paper, and means for lowering said delivery table by prescribed vertical length when detection output of said photoelectric detector continues over a prescribed time thereby to serially lower said delivery table in response to the piled amount of said continuous paper so that the upper plane of said continuous paper placed on said delivery table is continuously retained at a prescribed level.

15. An apparatus for intermittently feeding continuous paper in accordance with claim 12, wherein data on the folding direction of a paper end of said continuous paper is previously supplied and said delivery table is moved to a prescribed level by elevating means to feed said continuous paper to said folder while tracking paper feed length and said swing guide driving means is activated at such timing that said paper end of said continuous paper reaches a prescribed position of said swing guide to swing said swing guide in a predetermined direction on the basis of said data on said folding direction, thereby to automatically set said paper end of said continuous paper.

16. An apparatus for intermittently feeding continuous paper in accorddance with claim 1, wherein said contact/separation means further comprises:

eccentric shafts with which said impression cylinder is rotatably engaged, and a pulse motor connected with said eccentric shafts to rotate said eccentric shafts by a desired angle and responsively change the distance between shafts of said impression cylinder and said transfer cylinder thereby to control printing pressure between said impression cylinder and said transfer cylinder.

17. An apparatus for intermittently feeding continuous paper in accordance with claim 16, wherein said pulse motor rotates said eccentric shafts at an arbitrary angle within a range of a prescribed rotational phase angle ahead of the top dead center thereof.

18. An apparatus for intermittently feeding continuous paper in accordance with claim 16, further comprising:

printing pressure means for urging said eccentric shafts toward said transfer cylinder; and stoppers for restricting movement of said eccentric shafts urged by said printing pressure means, said pulse motor selectively rotating said eccentric shafts between a first rotational phase angle corresponding to a contact position and a second rotational phase angle corresponding to a separated position, said first and second rotational phase angles existing in the same rotating direction with respect to said top dead center of said eccentric shaft with said first rotational phase angle existing ahead of said top dead center by a slight angle, said impression cylinder being urged by said printing pressure means to be in contact with said transfer cylinder in said contact position, and movement of said eccentric shaft being restricted by said stopper in said separated position so that said impression cylinder is separated from said transfer cylinder.

19. An apparatus for intermittently feeding continuous paper in accordance with claim 18, wherein said printing pressure means comprises a primary spring with variable urging force and an secondary spring for supplying constant urging force.

20. An apparatus for intermittently feeding continuous paper in accordance with claim 16, further comprising:

a reset position sensor arranged on a rotational phase angle of said pulse motor corresponding to a reset position of said impression cylinder, a sensor dog rotating following rotation of said pulse motor to act on said reset position sensor, and means for rotating said pulse motor in a first rotational direction by prescribed counts and then rotating the same to a second rotational direction till detection by said reset position sensor to reset said impression cylinder in the position.

21. An apparatus for intermittently feeding continuous paper in accordance with claim 1, further comprising:

a pulse signal generator for generating a pulse signal in frequency responsive to the speed of displacement of said transfer cylinder, a phase detector for phase-detecting said generated pulse signal, an integration circuit for integrating output of said phase detector, an oscillator whose oscillation frequency is controlled by output of said integration circuit to generate a pulse signal at a prescribed multiplication rate with respect to said pulse signal, and means for frequency-dividing said pulse signal generated by said oscillator to subject the same to feedback to said phase detector as a reference signal, the time constant of said integration circuit being set so that frequency of said pulse signal generated by said oscillator is changed following to frequency variation of said pulse signal generated by said pulse signal generator.

22. An apparatus for intermittently feeding continuous paper in accordance with claim 21, wherein the time constant of said integration circuit is set to remove relatively high-frequency variation components from frequency variation components of said pulse signal generated by said pulse signal generator.

* * * * *